US009810421B2

(12) United States Patent
Kinnune et al.

(10) Patent No.: US 9,810,421 B2
(45) Date of Patent: Nov. 7, 2017

(54) LED LIGHT FIXTURE

(71) Applicant: Cree, Inc., Durham, NC (US)

(72) Inventors: Brian Kinnune, Racine, WI (US); Sandeep Pawar, Elmhurst, IL (US); Nicholas W. Medendorp, Jr., Raleigh, NC (US); David P. Goelz, Milwaukee, WI (US); Nathan Snell, Raleigh, NC (US)

(73) Assignee: Cree, Inc., Durham, NC (US)

( * ) Notice: Subject to any disclaimer, the term of this patent is extended or adjusted under 35 U.S.C. 154(b) by 279 days.

(21) Appl. No.: 14/269,077

(22) Filed: May 2, 2014

(65) Prior Publication Data

US 2015/0316249 A1 Nov. 5, 2015

(51) Int. Cl.

| | |
|---|---|
| ***F21V 29/83*** | (2015.01) |
| ***F21V 29/70*** | (2015.01) |
| ***F21V 23/02*** | (2006.01) |
| ***F21V 29/74*** | (2015.01) |
| ***F21V 5/04*** | (2006.01) |
| ***F21V 29/503*** | (2015.01) |
| ***F21K 9/60*** | (2016.01) |
| *F21Y 101/02* | (2006.01) |
| *F21W 131/10* | (2006.01) |
| *F21Y 115/10* | (2016.01) |

(52) U.S. Cl.

CPC ..... *F21V 29/83* (2015.01); *F21K 9/60* (2016.08); *F21V 5/04* (2013.01); *F21V 23/023* (2013.01); *F21V 29/503* (2015.01); *F21V 29/70* (2015.01); *F21V 29/74* (2015.01); *F21W 2131/10* (2013.01); *F21Y 2101/02* (2013.01); *F21Y 2115/10* (2016.08)

(58) Field of Classification Search

CPC ..... F21V 29/83; F21V 29/503; F21V 29/70; F21V 29/74; F21V 5/04; F21V 23/023; F21K 9/50

See application file for complete search history.

(56) References Cited

U.S. PATENT DOCUMENTS

| | | | |
|---|---|---|---|
| 7,350,940 | B2 | 4/2008 | Haugaard et al. |
| 2009/0034261 | A1 | 2/2009 | Grove |

(Continued)

OTHER PUBLICATIONS

DW Windsor Lighting, KIRIUM (Feb. 2014).

(Continued)

*Primary Examiner* — Mary Ellen Bowman
(74) *Attorney, Agent, or Firm* — Jansson Munger McKinley & Kirby Ltd.

(57) ABSTRACT

An LED light fixture including at least one LED light source thermally coupled to a heat-conductive structure. The heat-conductive structure having an LED-supporting region and heat-dissipating surfaces extending away therefrom. The at least one LED light source is thermally coupled to the LED-supporting region. The heat-conductive structure defines venting apertures bordering the at least one LED light source to facilitate ambient fluid flow to and from the heat-dissipating surfaces. In some embodiments, the LED light fixture includes a protrusion extending into a corresponding one of the venting apertures and oriented to direct air flow. In certain embodiments, the heat-conductive structure defines a plurality of venting apertures adjacent the at least one LED light source, the heat-dissipating surfaces include fins increasing in height at positions adjacent to the at least one of the venting apertures.

42 Claims, 21 Drawing Sheets

(56) References Cited

U.S. PATENT DOCUMENTS

| | | | |
|---|---|---|---|
| 2009/0251898 | A1 | 10/2009 | Kinnune et al. |
| 2010/0314985 | A1 | 12/2010 | Premysler |
| 2012/0025711 | A1 | 2/2012 | Best et al. |

OTHER PUBLICATIONS

LED Luminaire & Retrofit Solutions, Sensity Systems (Sep. 2013).
LED Roadway Luminaire Citadel Series, Sensity Systems (Mar. 2014).
Philips Gardco EcoForm LED site and area luminaire, Koninklijke Philips N.V. (Aug. 2013).
PureForm Specification Grade LED Luminaires, Koninklijke Philips N.V. (Sep. 2013).
Philips RoadView Series, Philips Roadway Lighting (Date).

FIG. 37
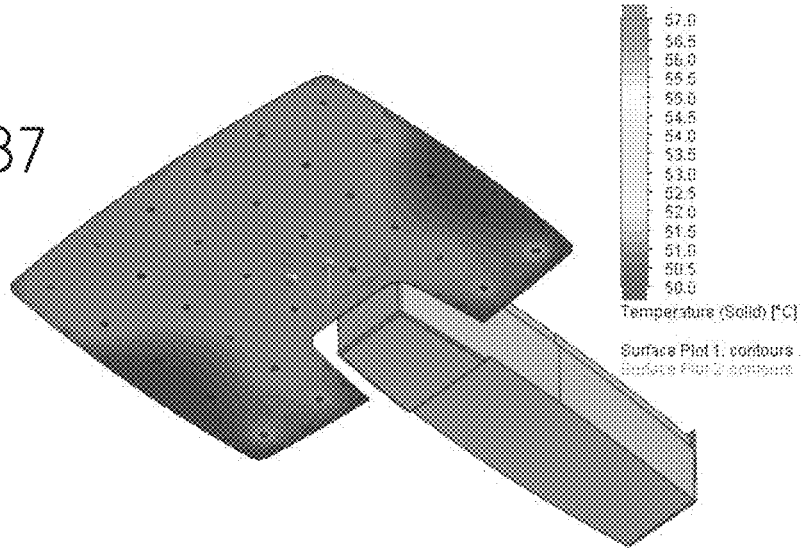
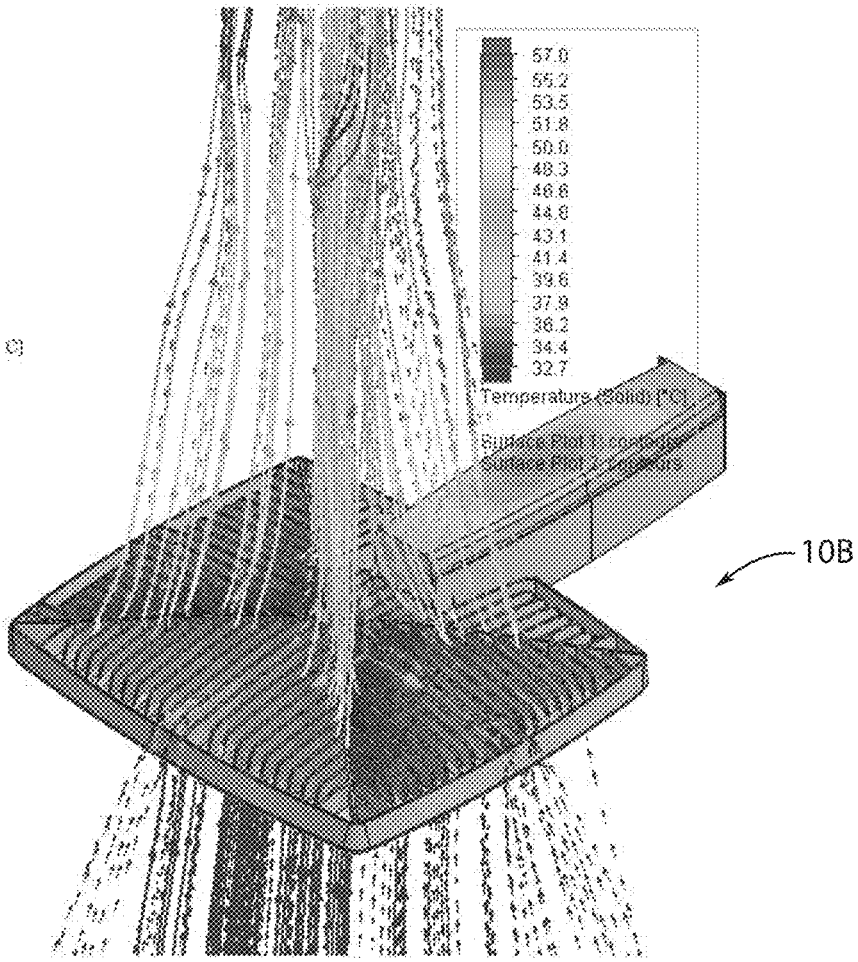
FIG. 38

LED LIGHT FIXTURE

FIELD OF THE INVENTION

This invention relates to light fixtures and, more particularly, to light fixtures using light-emitting diodes (LEDs).

BACKGROUND OF THE INVENTION

In recent years, the use of light-emitting diodes (LEDs) in development of light fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

High-luminance light fixtures using LED modules as light source present particularly challenging problems. One particularly challenging problem for high-luminance LED light fixtures relates to heat dissipation. Among the advances in the field are the inventions of U.S. Pat. Nos. 7,686,469 and 8,070,306.

Improvement in dissipating heat to the atmosphere is one significant objective in the field of LED light fixtures. It is of importance for various reasons, one of which relates to extending the useful life of the lighting products. Achieving improvements without expensive additional structure and apparatus is much desired. This is because a major consideration in the development of high-luminance LED light fixtures for various high-volume applications, such as roadway lighting, is controlling product cost even while delivering improved light-fixture performance.

Another challenge is that LEDs produce high temperatures during operation and other fixture portions need to be isolated or insulated for such high temperatures in order to maintain lower operating temperatures permitted for other parts of the fixture.

In summary, finding ways to significantly improve the dissipation of heat to the atmosphere from LED light fixtures would be much desired, particularly in a fixture that is easy and inexpensive to manufacture.

SUMMARY OF THE INVENTION

The present invention relates to improved LED light fixtures. In certain embodiments, the LED light fixture includes first and second fixture portions and at least one LED emitter on an LED heat sink in the first fixture portion. The first and second fixture portions define at least one opening permitting ambient-fluid flow through the fixture. The LED heat sink is open to ambient-fluid flow for removal of heat generated by the at least one LED during operation. The inventive LED light fixture includes at least one barrier structure along the at least one opening to thermally isolate the second fixture portion from the fluid flow heated by the first fixture portion.

The first and second fixture portions at least partially extend along a common plane with the at least one opening permitting ambient-fluid flow through the fixture transverse the common plane.

In certain embodiments of the LED light fixture, the first and second fixture portions are formed as one piece.

In certain embodiments, the second fixture portion forms a substantially closed chamber enclosing power-circuitry unit with permitted operating temperatures lower than operating temperatures of the at least one LED emitter.

The heat sink may include at least one edge-fin transverse to the common plane and extending along the opening away from the at least one LED emitter to a distal edge-fin end. The at least one edge-fin may form the barrier structure.

In some embodiments, the barrier structure is disposed within the at least one opening between the LED heat sink and the second fixture portion to thermally decouple heat sources of the first and second fixture portions.

Certain embodiments of the inventive LED light fixture further include a perforated cover which is in contact with the distal edge-fin end and extending therefrom substantially along the common plane away from the opening. In such embodiments, the cover conductively receives heat from the fins. The perforations of the cover further direct LED-generated heat carried by the fluid flow along the first fixture portion away from the second fixture portion.

In certain embodiments, the heat sink includes a plurality of fins transverse to the common plane and extending away from the at least one LED emitter to distal fin ends. In some of such embodiments, the cover is in thermal contact with the distal fin edges.

The heat sink may have a base with an LED-supporting region and an opposite heat-dissipating region which includes the plurality of fins. In some of such embodiments, the plurality of fins includes at least one edge-fin extending along the opening. At least a subset of the fins may extend substantially parallel to the edge-fin.

The heat sink may further include at least one central venting aperture facilitating ambient-fluid flow to and from a central region of the heat sink. The heat sink may also have at least one peripheral venting aperture along peripheral regions facilitating ambient-fluid flow to and from the heat-dissipating region of the heat sink.

In some of such embodiments, the fins extend farther from the base in the central region than in the peripheral regions. Because the airflow velocity is higher in the center than along the periphery, fins being taller in the center enhances the fin efficiency for the given airflow.

At least some fins of the subset may define horizontal between-fin channels open at the peripheral regions and extending therefrom to the central region.

In certain embodiments, the LED light fixture further includes a peripheral deflector member along each peripheral venting aperture. Each peripheral deflector member may have at least one beveled deflector surface oriented to direct and accelerate air flow from the peripheral venting aperture toward the central region.

In some embodiments, the LED light fixture further includes a central deflector member along the central venting aperture. In some versions, the central deflector member has a pair of oppositely-facing beveled deflector surfaces oriented to direct and accelerate air flow from the central venting aperture toward peripheral regions.

The flow deflectors facilitate effectiveness of the heat-dissipating region and the overall efficiency of heat removal from the entire heat sink for substantially uniform temperatures thereacross.

In another aspect of the present invention, the LED light fixture includes at least one LED light source, which includes at least one LED emitter, and a heat-conductive structure including an LED-supporting region and heat-dissipating surfaces extending away therefrom, the at least one LED light source being thermally coupled to the LED-supporting region. The heat-conductive structure defines venting apertures bordering the at least one LED light source to facilitate ambient fluid flow to and from the heat-dissipating surfaces. The LED light fixture may have a protrusion extending into a corresponding one of the venting apertures and oriented to direct air flow to and along the heat dissipating surfaces.

The protrusion may be part of the heat-conductive structure extending outwardly from the LED-supporting region thereof. In some other embodiments, the protrusion is part of the LED light source and extends outwardly from the at least one LED emitter.

Certain embodiments of the inventive LED light fixture further include a lens member secured to the heat-conductive structure and enclosing the at least one LED light source. The lens member has at least one light-transmissive lens portion and an edge portion extending outwardly therefrom. The edge portion may form the protrusion with a beveled rear surface bordering a corresponding one of the venting apertures and oriented to direct and accelerate air flow from the venting aperture to and along the heat-dissipating surfaces.

Some embodiments of the inventive LED light fixture further include a deflector member along each of the venting apertures. The deflector member has at least one beveled deflector surface angled off-vertical in substantially common direction as the beveled rear surface of the lens member and oriented to accelerate and redirect inwardly upward air flow from the venting aperture toward the heat-dissipating surfaces.

In some of such embodiments, each deflector member is part of the heat-conductive structure. Each deflector member and the heat-conductive structure may be parts of a single-piece structure.

In certain embodiments, the at least one LED light source includes a plurality of spaced apart LED light sources. In such embodiments, the venting apertures may include at least one inner venting aperture between adjacent LED light sources and peripheral venting apertures bordering the LED-mounting region. Each lens member may have at least one edge portion with the beveled rear surface bordering the at least one inner venting aperture.

Certain versions of the inventive LED light fixture may include a peripheral deflector member along each of the peripheral venting apertures. The peripheral deflector member has at least one beveled deflector surface angled off-vertical in substantially common direction as the beveled rear surface of the lens member and oriented to accelerate and redirect inwardly upward air flow from the peripheral venting aperture toward the heat-dissipating surfaces.

Some versions of the inventive LED light fixture may also include an inner deflector along the at least one inner venting aperture. The inner deflector has a pair of oppositely-facing beveled deflector surfaces each angled off-vertical in substantially common direction as the beveled rear surface of the adjacent lens member and oriented to further accelerate and redirect inwardly upward air flow from the peripheral venting aperture toward the heat-dissipating surfaces.

In yet another aspect of the present invention, the LED light fixture includes at least one LED light source and a heat-conductive structure having an LED-supporting region and heat-dissipating fins extending away therefrom. The at least one LED light source is thermally coupled to the LED-supporting region. The heat-conductive structure defines a plurality of venting apertures adjacent the at least one LED light source. The fins increase in height at positions adjacent to the at least one of the venting apertures.

In some of such embodiments, the at least one LED light source includes a plurality of spaced apart LED light sources. The venting apertures include at least one inner venting aperture between adjacent LED light sources and peripheral venting apertures bordering the LED-mounting region. The fins increasing in height at positions adjacent the at least one inner venting aperture.

In certain embodiments, the fins are spanning between the peripheral venting apertures and form between-fin channels across the heat-conductive structure. In such embodiments, the peripheral deflector member is positioned along each peripheral venting aperture to redirect inwardly upward air flow from the peripheral venting aperture to the heat-dissipating fins and along the between-fin channels.

There may be the inner deflector member positioned along the at least one inner venting aperture to redirect inwardly upward air flow from the at least one inner venting aperture to the heat-dissipating fins and along the between-fin channels.

Certain embodiments include a barrier structure dividing the inner venting aperture to separate flow paths corresponding to each of the adjacent LED light sources.

Another aspect of the present invention is the heat-conductive structure defining venting apertures along the at least one LED light source and forming at least one beveled aperture-inlet surface oriented to redirect inwardly upward air flow from the venting aperture to and along the heat-dissipating surfaces.

Some of such embodiments include the lens member secured to the heat-conductive structure and enclosing the at least one LED light source. The lens member has an edge portion having a beveled rear surface bordering a corresponding one of the venting apertures and angled off-vertical in substantially common direction as the beveled aperture-inlet surface of the heat-conductive structure.

In another aspect of the present invention, the LED light fixture includes at the at least one LED light source which has at least one longer side and at least one shorter side. The heat-conductive structure defines venting apertures bordering the at least one longer side of each of said at least one LED light source.

In some embodiments, the at least one LED light source includes a plurality of spaced apart LED light sources each having longer sides and shorter sides. In some of such embodiments, the heat-conductive structure defines a venting aperture bordering said longer sides of said plurality of LED light sources.

The term "ambient fluid" as used herein means air and/or water around and coming into contact with the light fixture.

As used herein in referring to portions of the devices of this invention, the terms "upward," "upwardly," "upper," "downward," "downwardly," "lower," "upper," "top," "bottom" and other like terms assume that the light fixture is a position for downward illumination.

In descriptions of this invention, including in the claims below, the terms "comprising," "including" and "having" (each in their various forms) and the term "with" are each to be understood as being open-ended, rather than limiting, terms.

BRIEF DESCRIPTION OF THE DRAWINGS

FIG. 37 is a schematic perspective view from below of the LED lighting of FIG. 35 showing temperature distribution along LED light source during operation.

FIG. 38 is another perspective view from above of the LED light fixture of FIG. 35 schematically illustrating air-flow vectors through the fixture.

DETAILED DESCRIPTION OF EXEMPLARY EMBODIMENTS

Figure 1:
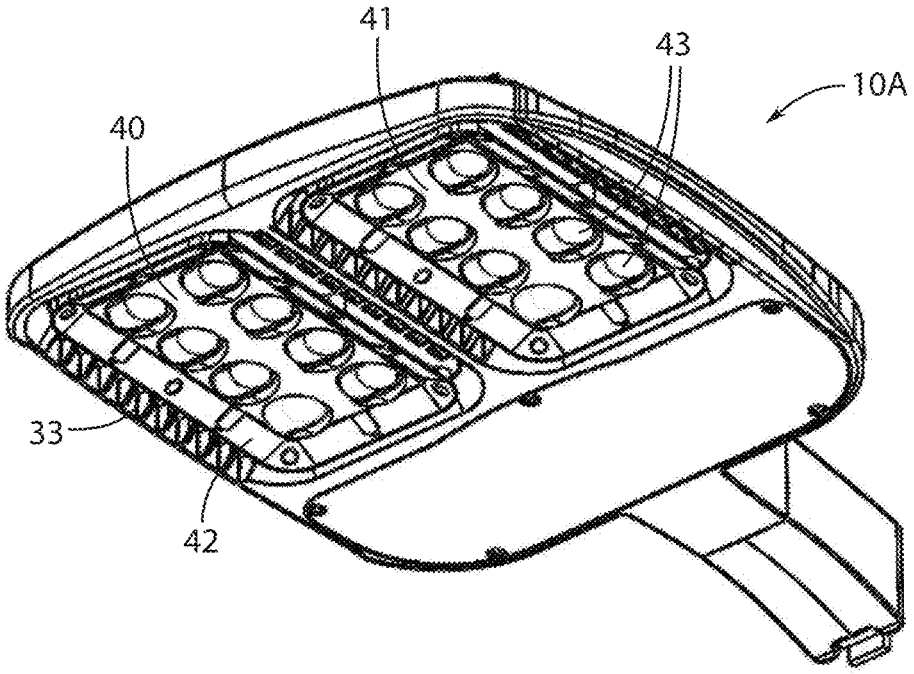
FIG. 1 is a perspective view from below of one embodiment of an LED light fixture in accordance with this invention.
Figure 2:
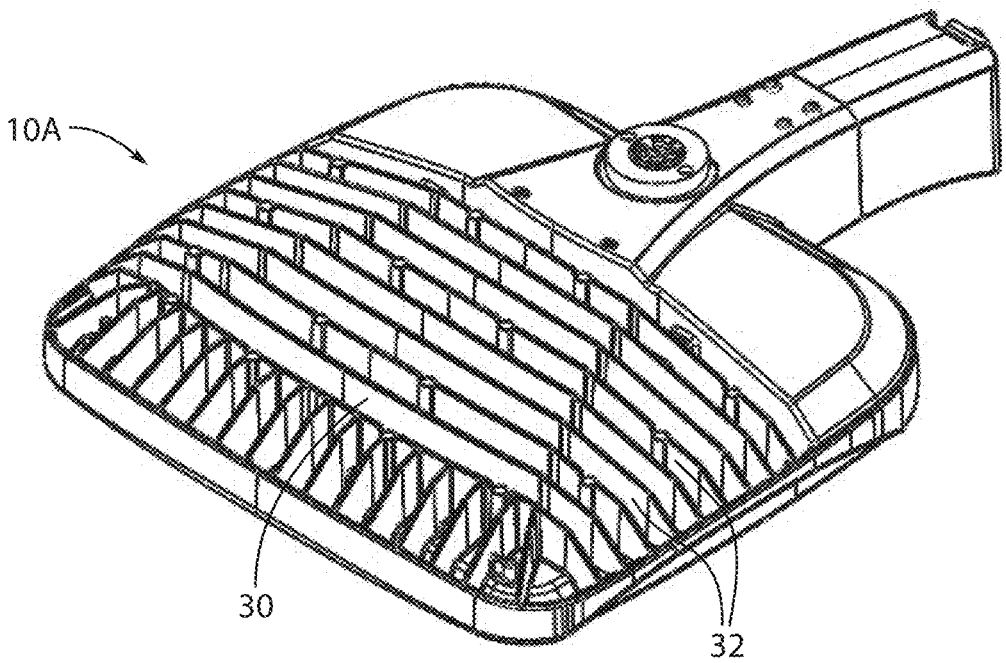
FIG. 2 is a perspective view from above of the LED light fixture of FIG. 1.
Figure 3:
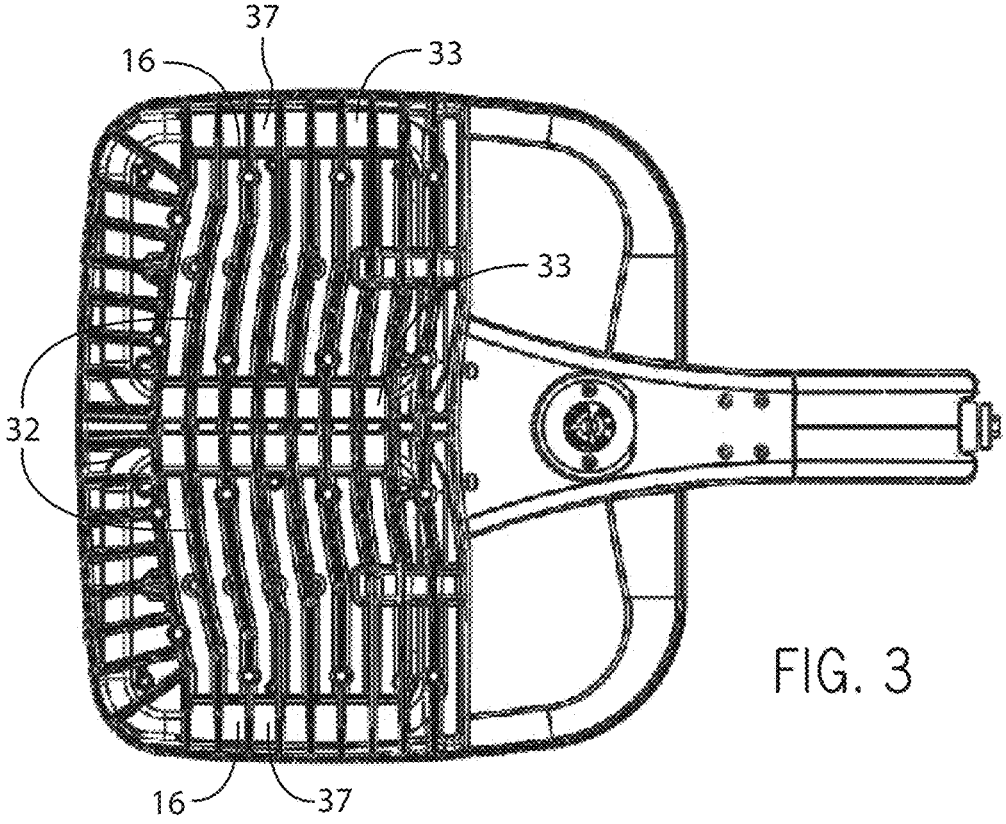
FIG. 3 is a top plan view of the LED light fixture of FIG. 1.
Figure 4:
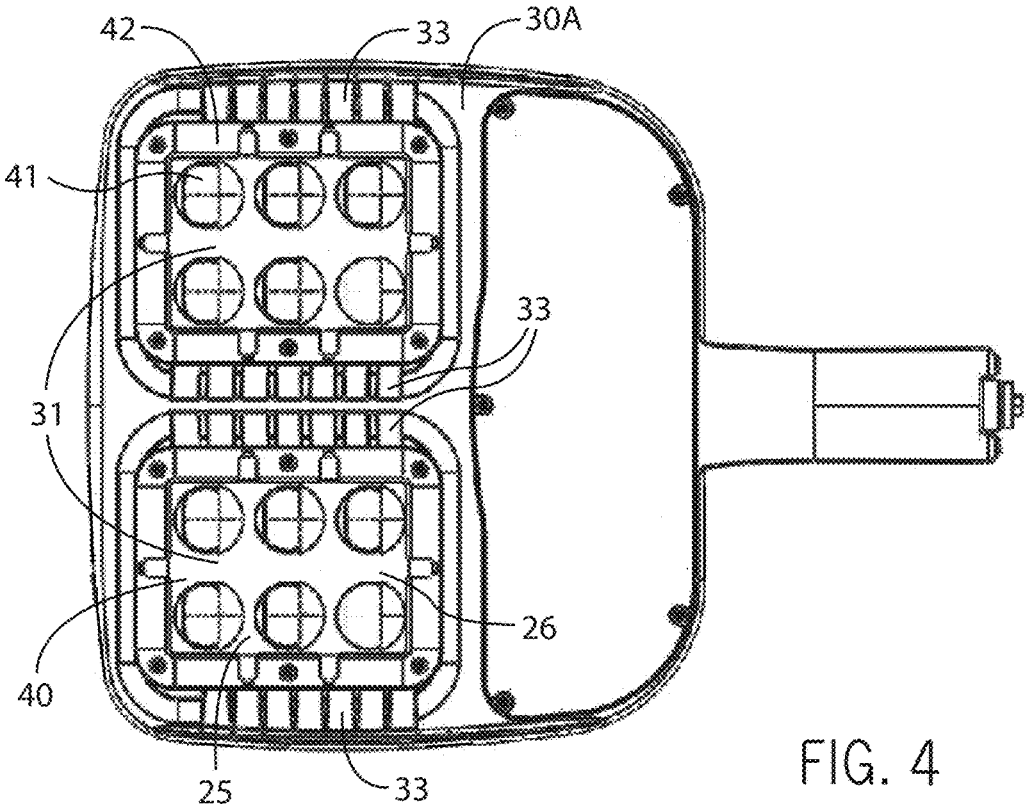
FIG. 4 is a bottom plan view of the LED light fixture of FIG. 1.
Figure 5:
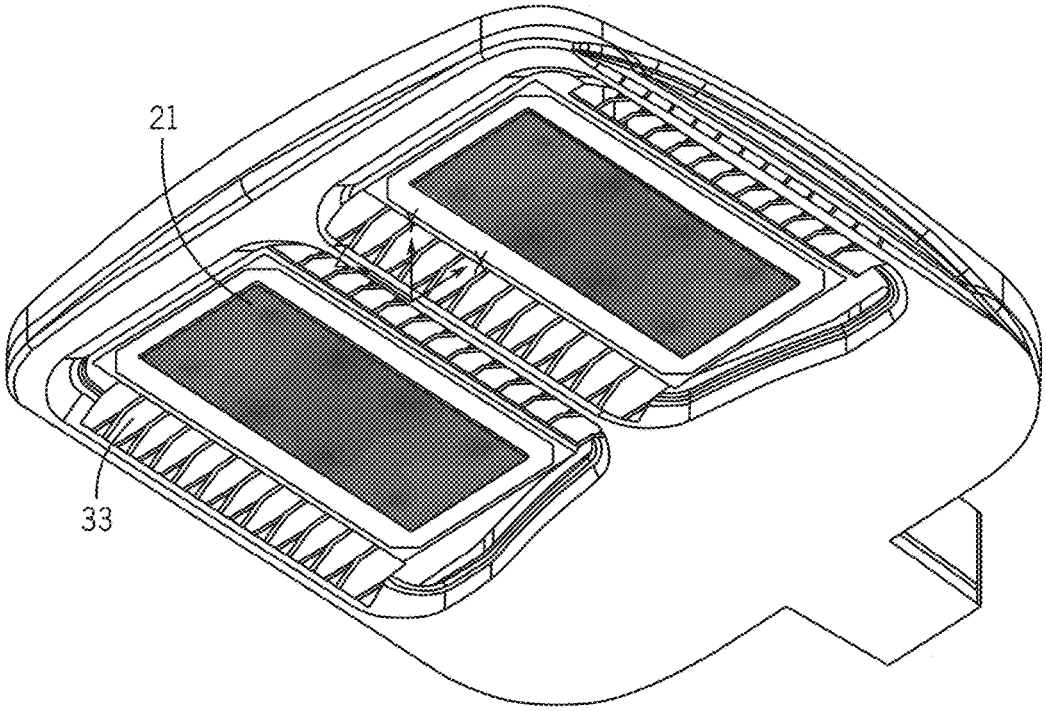
FIG. 5 is a schematic perspective view from below of the LED lighting of FIG. 1 showing temperature distribution along LED-array modules during operation.

The figures illustrate exemplary embodiments of LED light fixtures in accordance with this invention. Common or similar parts in different embodiments are given the same numbers in the drawings; the light fixtures themselves are often referred to by the numeral 10 followed by different letters with respect to alternative embodiments.

FIGS. 1-17 and 27-38 illustrate a light fixture 10 which includes at least one LED light source 20 and a heat-conductive structure 30 (also referred hereto as a heat sink) including an LED-supporting region 31 and heat-dissipating surfaces 32 extending away therefrom. FIGS. 1, 4, 5 and 27-34 illustrate one embodiment of light fixture 10A which includes a pair of LED light sources 20A each including a plurality of LED emitters 21. FIG. 35 shows another embodiments of light fixture 10B which has a single LED light source 20B with a plurality LED emitters 21. LED light sources 20 are thermally coupled to LED-supporting region 31. As seen in FIGS. 1, 3-6, 8, 15, 27-32, 35 and 38, the heat-conductive structure 30 defines venting apertures 33 bordering LED light sources 20 to facilitate ambient fluid flow to and from heat-dissipating surfaces 32.

FIGS. 6, 11 and 27-32 best show LED light fixture 10A having a protrusion 14 extending into a corresponding one of venting apertures 33A and oriented to direct air flow to and along heat-dissipating surfaces 32.

Figure 6:
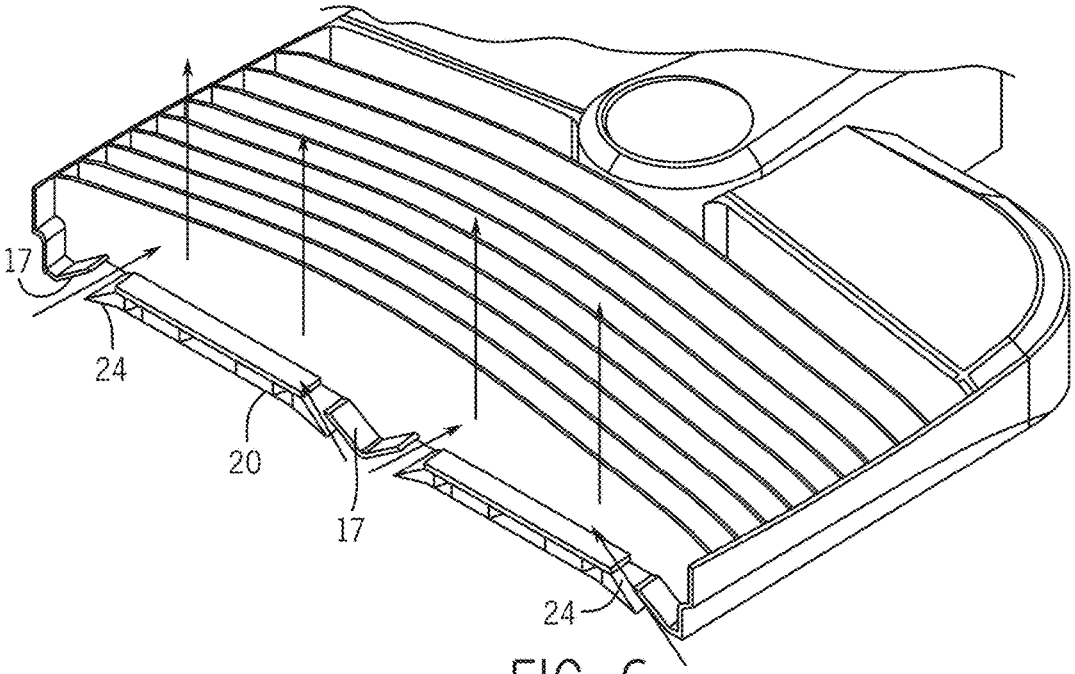
FIG. 6 is a sectional perspective view from above of the LED light fixture showing air-flow direction through the heat-conductive structure.
Figure 11:
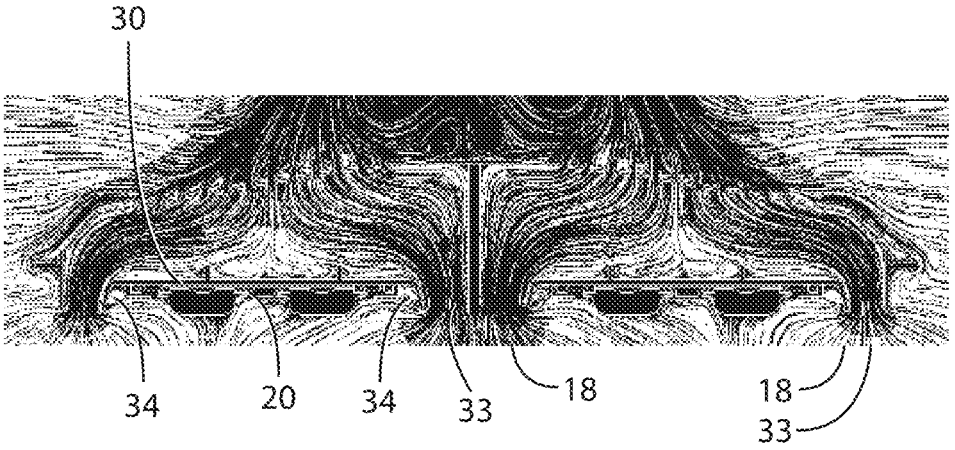
FIG. 11 is another schematic cross-sectional front view of an embodiment similar to that shown in FIG. 7 but including a perforated cover, schematically showing streamlines of air-flow through the fixture with a baffle in the center of the heat sink separating the two airstreams and isolating the two heat sources.

FIG. 11 shows protrusion 34 as part of heat-conductive structure 30 extending outwardly from LED-supporting region 31 into adjacent venting aperture 33. FIG. 6 shows protrusion 24 is part of the LED light source 20 extending outwardly from LED emitter 21 into adjacent venting aperture 33.

Figure 32:
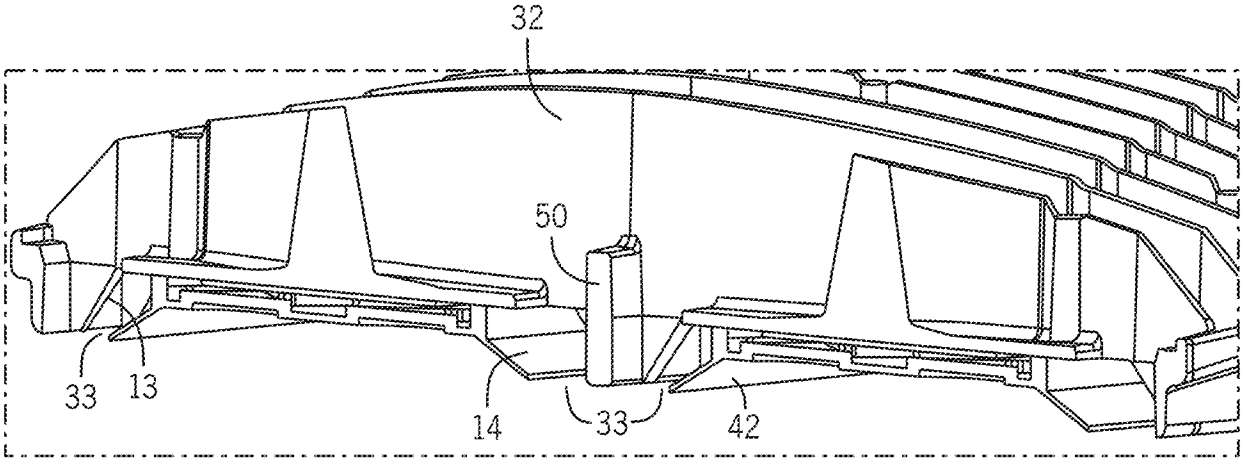
FIG. 32 is another larger-scale fragmentary perspective view of the LED light fixture of FIG. 1 showing the venting-aperture features.
Figure 33:
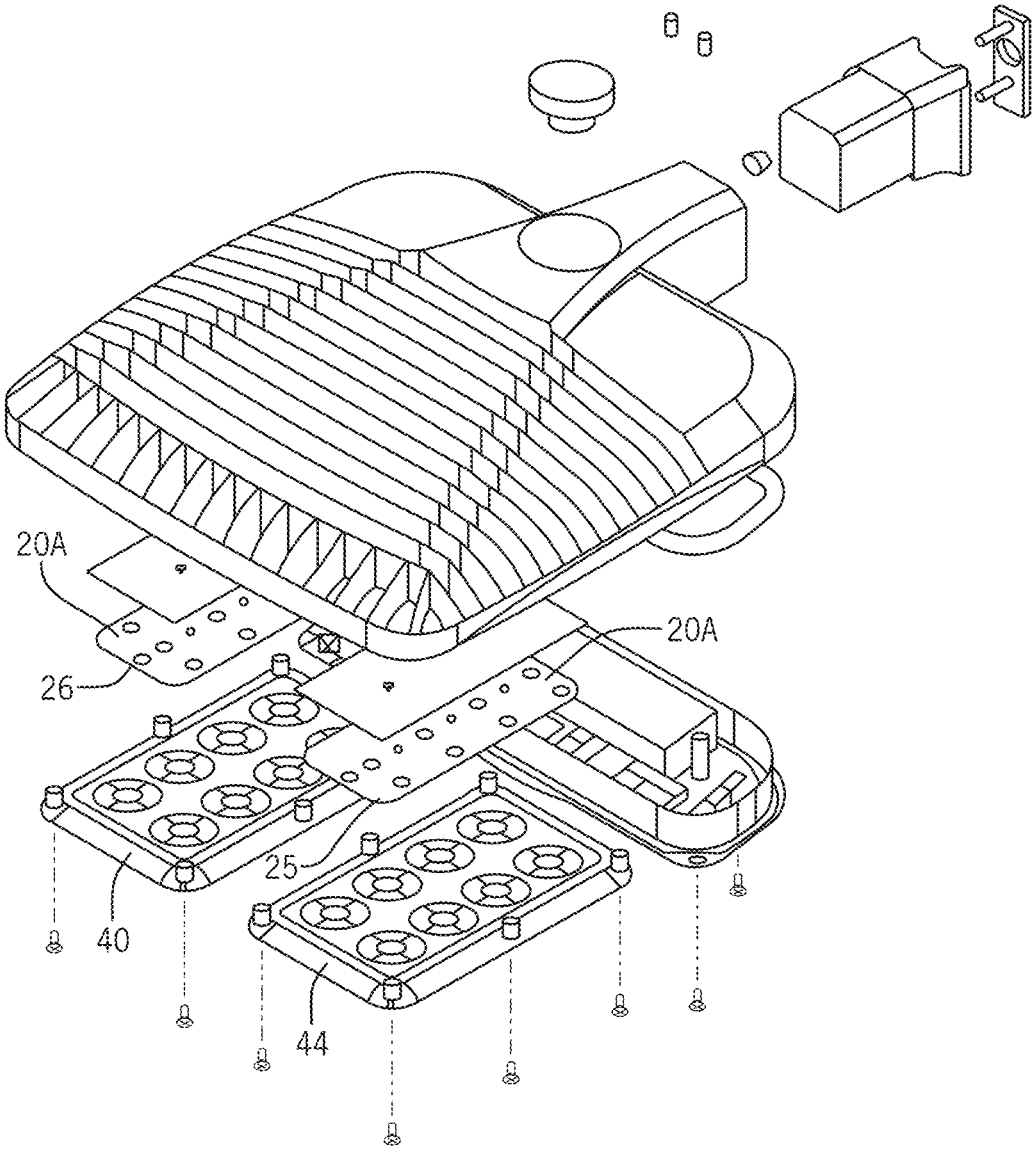
FIG. 33 is an exploded perspective view from above of LED light fixture of FIG. 1.
Figure 34:
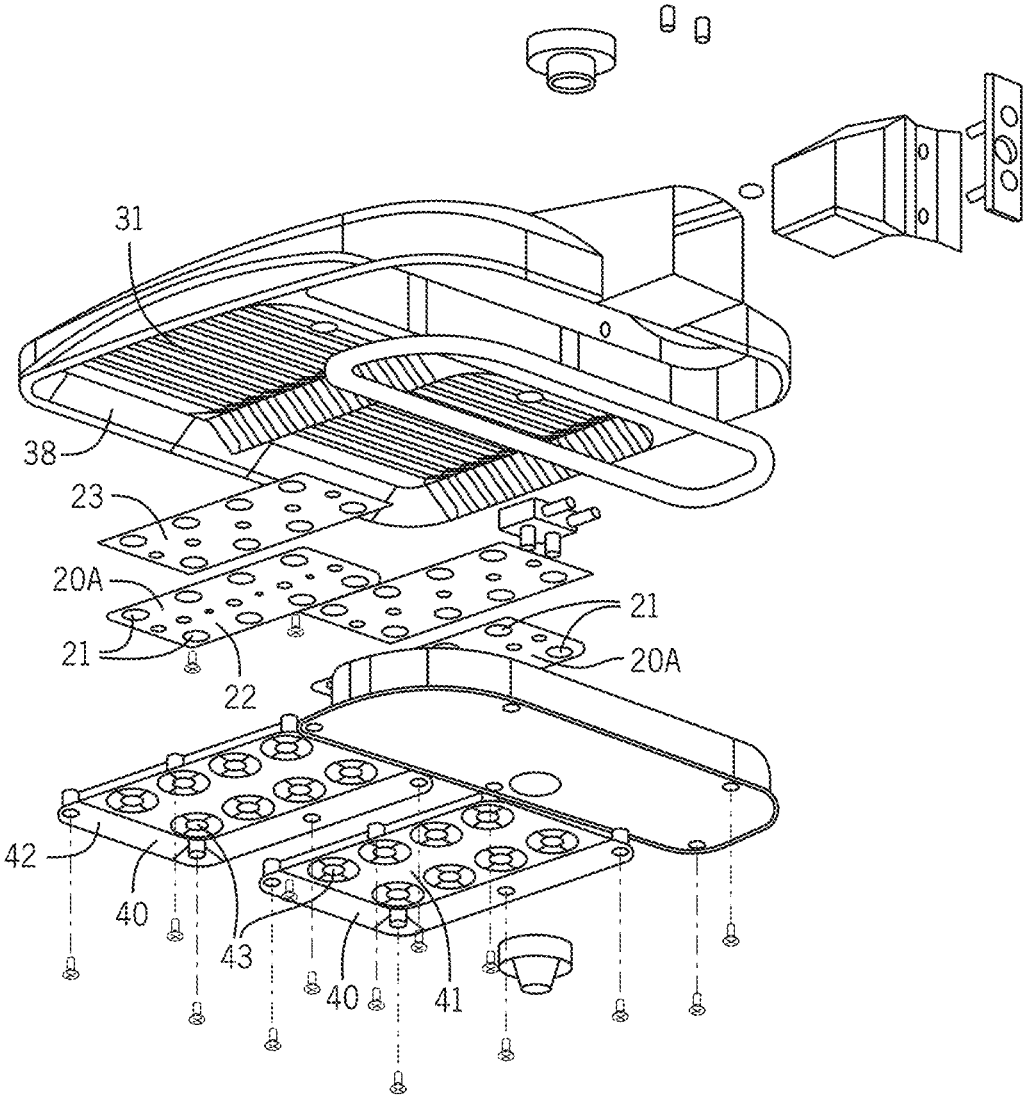
FIG. 34 is an exploded perspective view from below of LED light fixture of FIG. 1.
Figure 35:
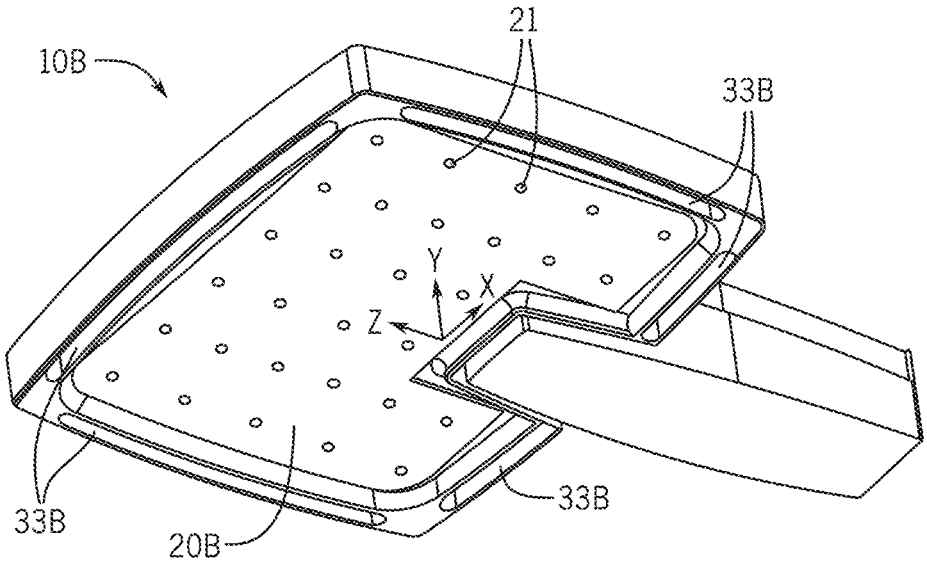
FIG. 35 is a perspective view from below of another embodiment of an LED light fixture in accordance with this invention.

FIGS. 1, 4 and 27-34 show light fixture 10A further including a lens member 40 secured to heat-conductive structure 30 and enclosing LED light source 20. As best seen in FIGS. 1, 4 and 27-34, lens member 40 has a lens portions 41 and an edge portion 42 extending outwardly therefrom. FIGS. 33 and 34 show that each light-transmissive part 43 of lens portion 41 is aligned with a corresponding one of LED emitters 21 spaced on a circuit board 22. FIGS. 33 and 34 also show a safety layer 23 positioned between lens member 40 and circuit board 22. Features and benefits of safety layer 23 are disclosed in more detail in U.S. Pat. No. 7,938,558, co-owned with the present application; the entire contents of this patent is incorporated herein by reference.

FIGS. 27-30 show edge portion 42 forming protrusion 14 with a beveled rear surface 44 bordering a corresponding one of venting apertures 33 and oriented to direct and accelerate air flow from such venting aperture 33 to and along heat-dissipating surfaces 32 in the form of fins.

Figure 8:
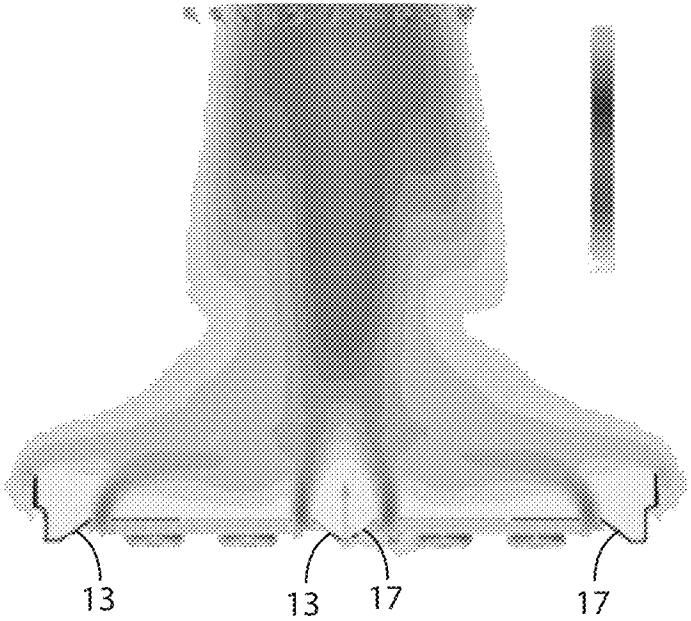
FIG. 8 is a schematic cross-sectional front view of another embodiment with a heat sink supporting two LED-array modules and having venting apertures with a beveled top inlet, showing air-flow direction and the resulting heat dissipation during operation.

FIGS. 6, 8 and 27-30 show that fixture 10A further includes a deflector member 17 along each of venting apertures 33. Deflector member 17 has a beveled deflector surface 13 angled off-vertical in substantially common direction as beveled rear surface 44 of lens member 40 and oriented to accelerate and redirect inwardly upward air flow from venting aperture 33 toward heat-dissipating surfaces 32, as seen in FIGS. 6 and 8.

Figure 27:
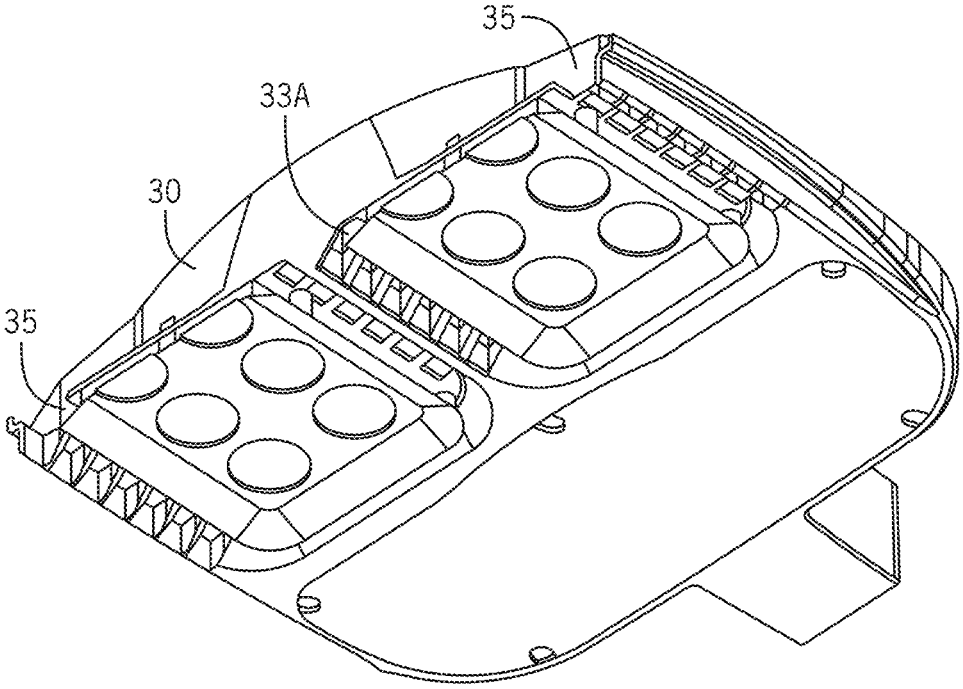
FIG. 27 is a fragmentary perspective view of the LED light fixture of FIG. 1 with a section along lines 27-27 seen on FIG. 3, showing venting-aperture features facilitating direction of air flow to and along the heat sink.
Figure 28:
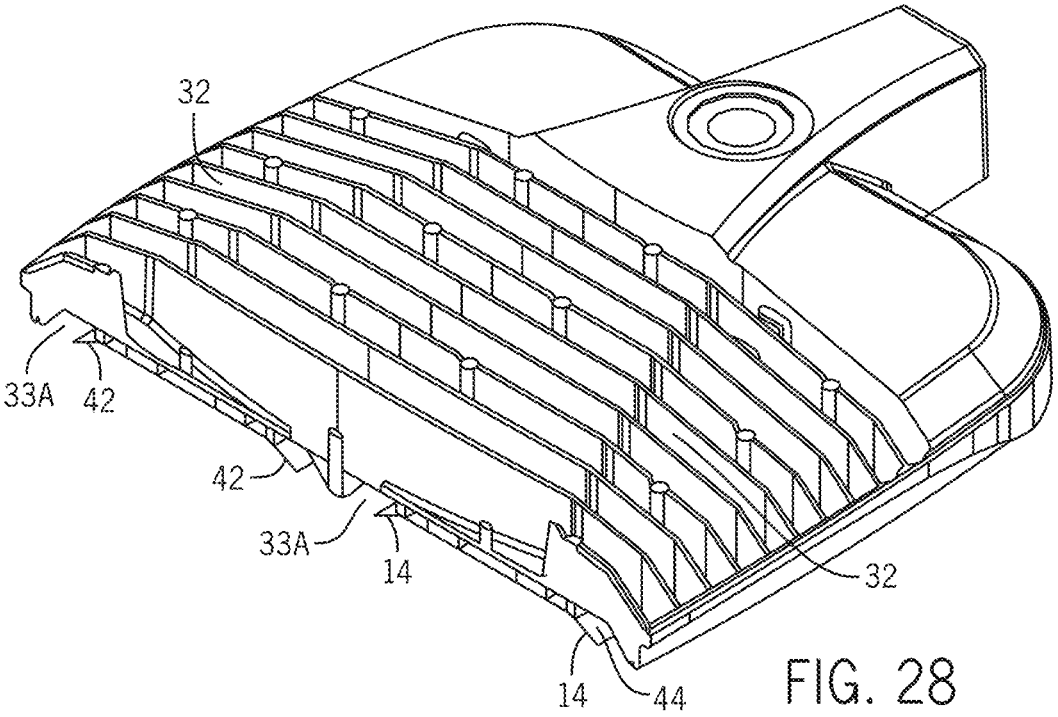
FIG. 28 is a fragmentary perspective view of the LED light fixture of FIG. 1 with a section along lines 28-28 seen on FIG. 3, showing venting-aperture features facilitating direction of air flow to and along the heat sink.

FIGS. 27-30 show each deflector member 17 as part 35 of heat-conductive structure 30. It is best seen in FIG. 27 that each deflector member and the heat-conductive structure are parts of a single-piece structure.

FIGS. 6-8 and 27-32 show venting apertures 33 including an inner venting aperture 36 between adjacent LED light sources 20 and peripheral venting apertures 37 bordering LED-mounting region 31. Each lens member 40 is shown to have edge portion 42 with beveled rear surface 44 bordering adjacent inner venting aperture 36 and peripheral venting aperture 37.

Figure 29:
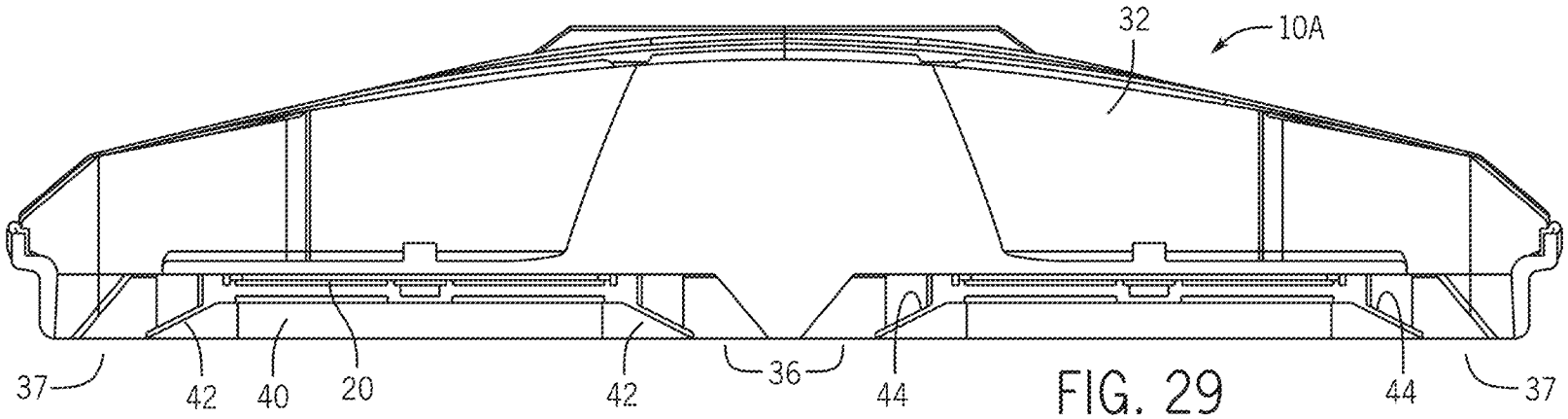
FIG. 29 is a front cross-section view as in FIG. 27.
Figure 29B:
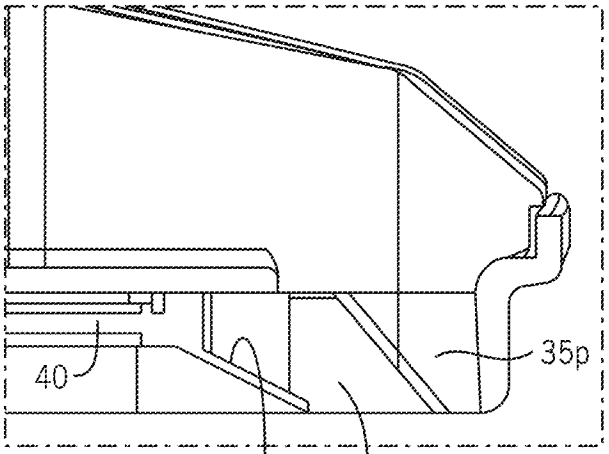
FIG. 29B is a larger-scale fragment of a peripheral portion of FIG. 29.

LED light fixture 10A has a peripheral deflector member 35*p* along each of peripheral venting apertures 37. As best seen in FIGS. 29 and 29B, peripheral deflector member 35*p* has a beveled deflector surface 38 angled off-vertical in substantially common direction as beveled rear surface 44 of lens member 40 and oriented to accelerate and redirect inwardly upward air flow from peripheral venting aperture 37 toward heat-dissipating surfaces 32, as seen in FIGS. 6 and 8.

Figure 29A:
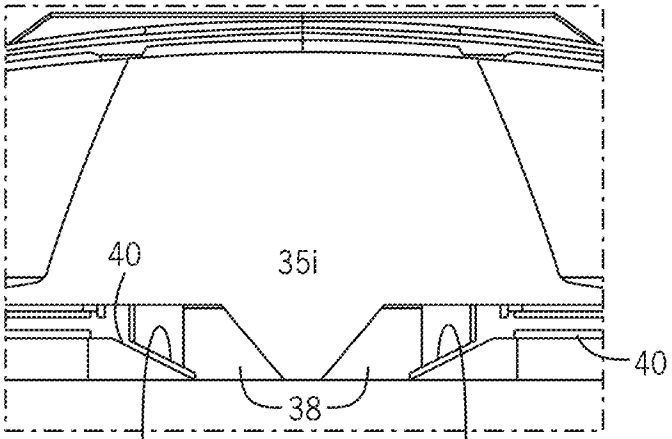
FIG. 29A is a larger-scale fragment of a central portion of FIG. 29.
Figure 30:
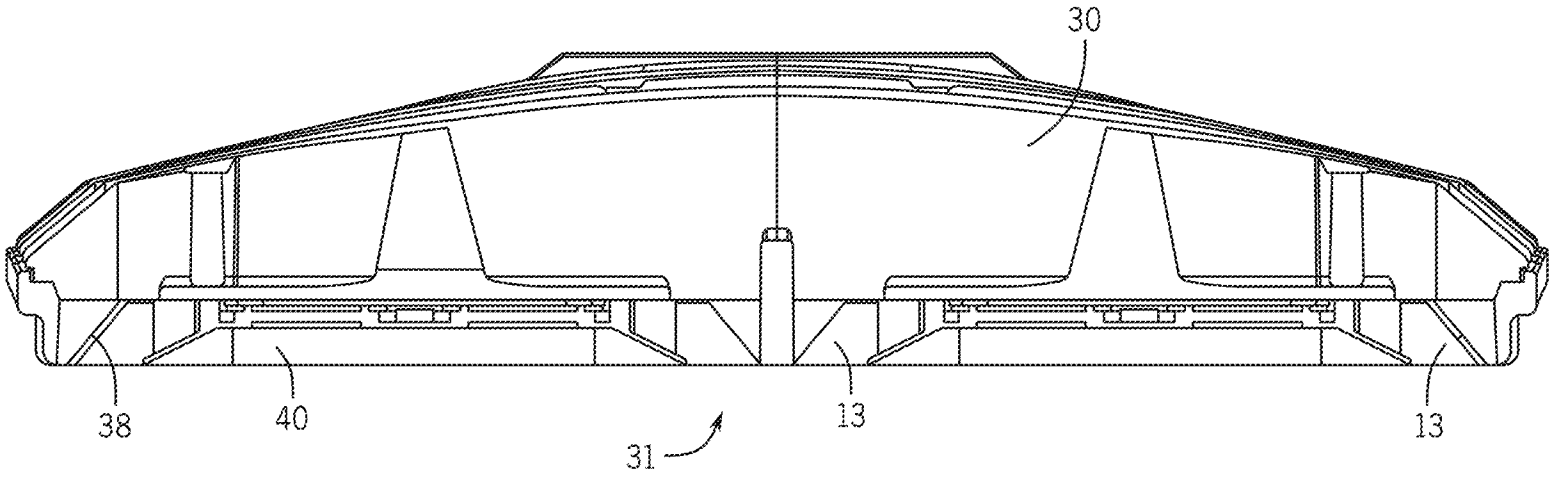
FIG. 30 is a front cross-section view as in FIG. 28.
Figure 31:
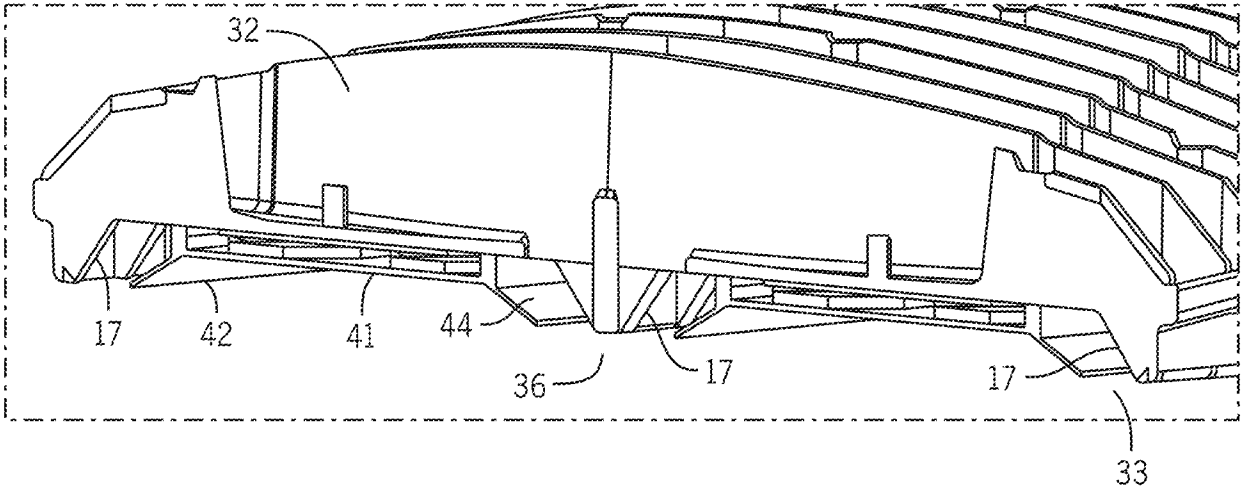
FIG. 31 is a larger-scale fragmentary perspective view of the LED light fixture of FIG. 1 showing the venting-aperture features.

LED light fixture 10A also has an inner deflector 35*i* along inner venting aperture 36. As best seen in FIGS. 29 and 29A, inner deflector 35*i* has a pair of oppositely-facing beveled deflector surfaces 38 each angled off-vertical in substantially common direction as beveled rear surface 44 of adjacent lens member 40 and oriented to further accelerate and redirect inwardly upward air flow from the peripheral venting aperture toward the heat-dissipating surfaces.

FIGS. 27-32 illustrate heat fins 32 increasing in height at positions adjacent to inner venting aperture 36. FIGS. 2, 3, 15 and 27-34 show fins 32 spanning between peripheral venting apertures 37 and forming between-fin channels 16 across heat-conductive structure 30. In embodiments of light fixture 10A, peripheral deflector member 35*p* positioned along each peripheral venting aperture 37 redirects inwardly upward air flow from peripheral venting aperture 37 to heat-dissipating fins 32 and along between-fin channels 16, as seen in FIG. 8. Inner deflector member 35*i* is positioned along inner venting aperture 36 to redirect inwardly upward air flow from inner venting aperture 36 to heat-dissipating fins 32 and along the between-fin channels 16.

Figure 7:
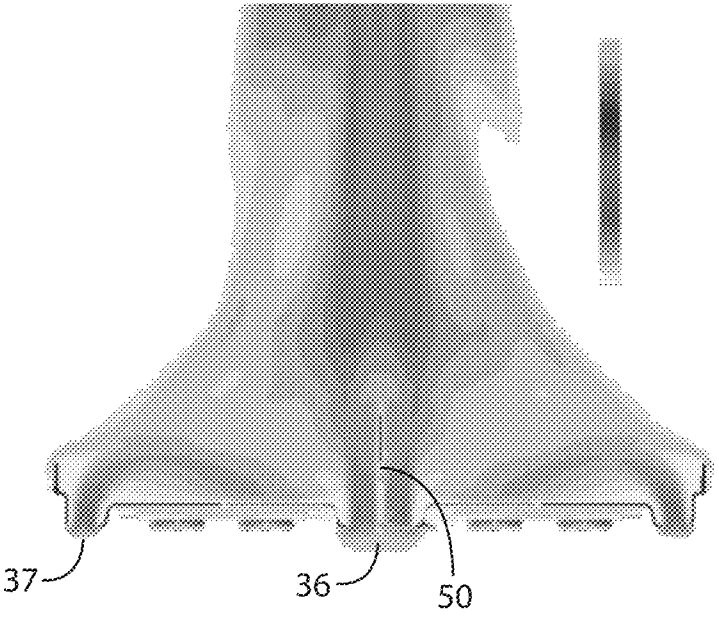
FIG. 7 is a schematic cross-sectional front view of one embodiment with a heat sink including a barrier between two LED-array modules, showing air-flow direction and the resulting heat dissipation during operation.

FIG. 7 shows a comparative illustration of air-flow direction and resulting inferior heat dissipation in a light fixture without deflector members in venting apertures.

FIGS. 1, 4, 33 and 34 best show that each of spaced apart LED light sources 20A has longer sides 25 and shorter sides 26. Heat-conductive structure 30A defines venting apertures 33 bordering longer sides 25 of each of LED light sources 20A.

Figure 36:
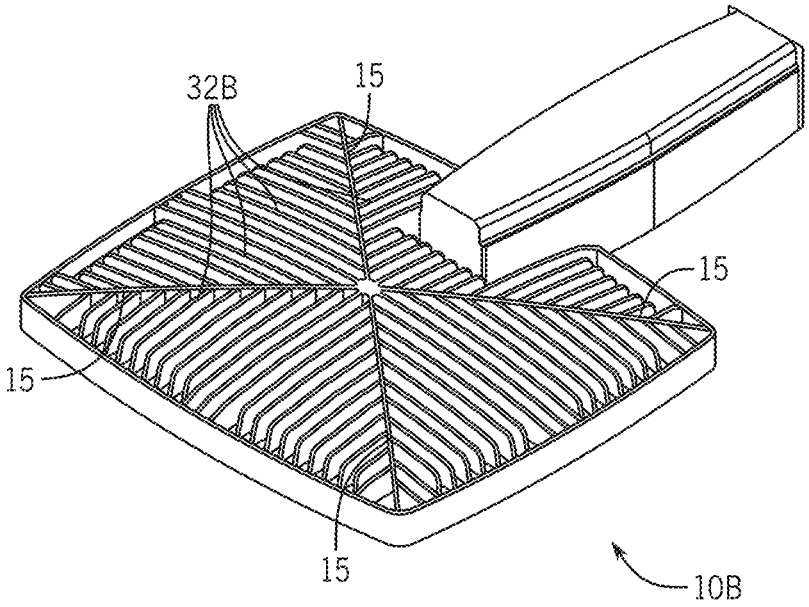
FIG. 36 is a perspective view from above of the LED light fixture of FIG. 35.

FIGS. 35-38 illustrate light fixture 10B with one LED light source 20B including a plurality of spaced LED emitters 21. As seen in FIG. 35, fixture 10 B has cooling 'ports' (or vents) 33 on all four sides of LED light source 20B. It is best seen in FIG. 36 that fixture 10B also has diagonal baffles 15 to maximize flow of air through fins 32 and improve effectiveness of fins 32B. FIG. 36 also shows that fixture 10B has a perpendicular fin orientation which helps mix the airflow and increase heat transfer coefficient, as seen in FIG. 38. FIG. 37 schematically illustrates a temperature plot showing that, because of effective use of the available surface area, the LED temperature distribution is fairly uniform.

Figure 17:
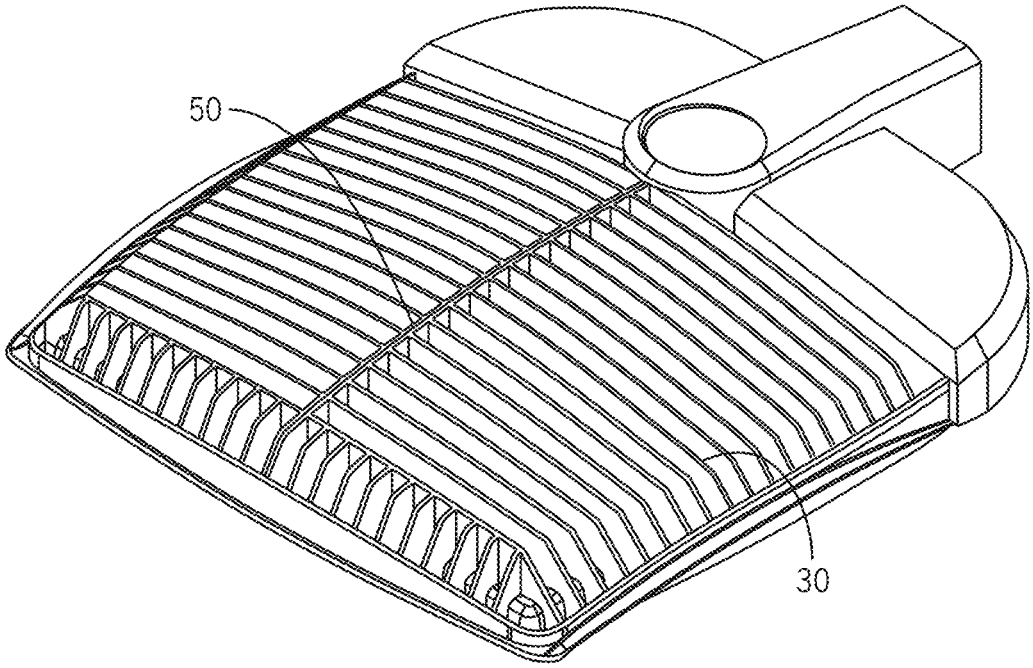
FIG. 17 is a perspective view of an embodiment with a heat sink including a barrier similar to the embodiment shown in FIG. 7.
Figure 18:
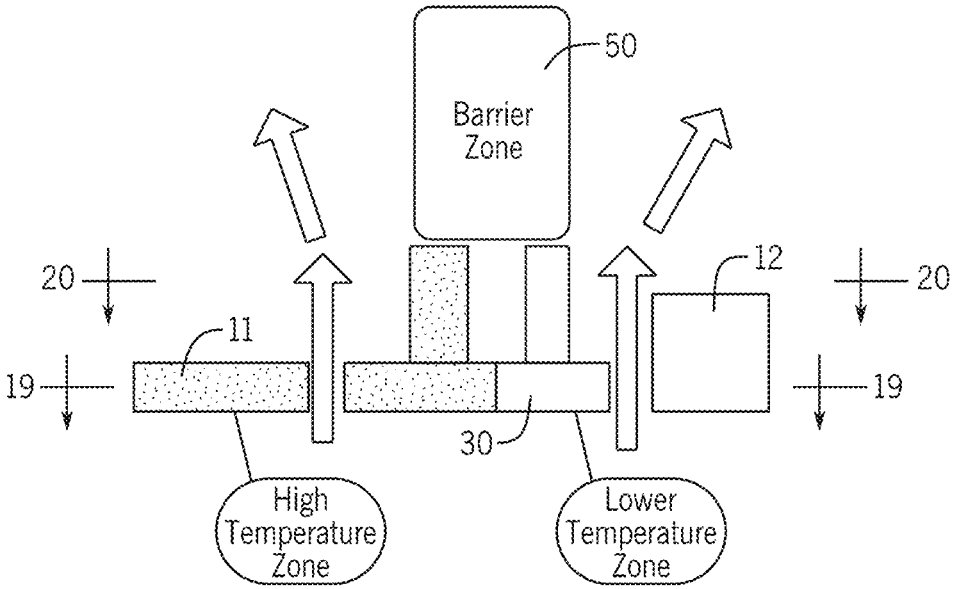
FIG. 18 is a schematic side-view illustration of a light-fixture configuration including a thermal barrier separating fixture zones with higher and lower permitted operating temperatures, the barrier including a solid bottom and an air pocket thereabove.
Figure 19:
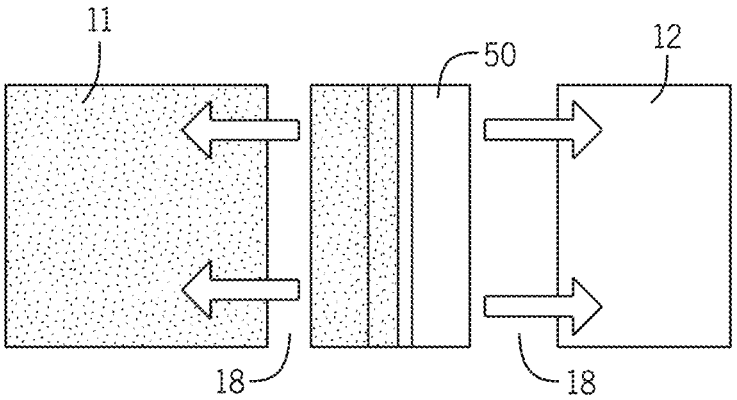
FIG. 19 is a schematic sectional plan view of the light-fixture illustrated in FIG. 18, taken along lines 19-19 seen in FIG. 18.
Figure 20:
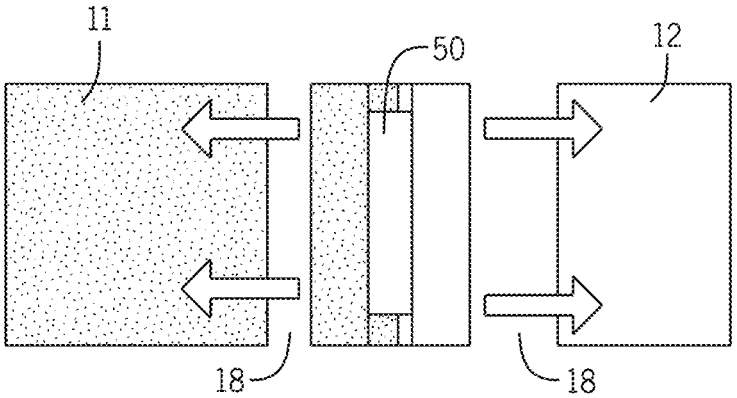
FIG. 20 is a schematic sectional plan view of the light-fixture illustrated in FIG. 18, taken along lines 20-20 seen in FIG. 18.
Figure 21:
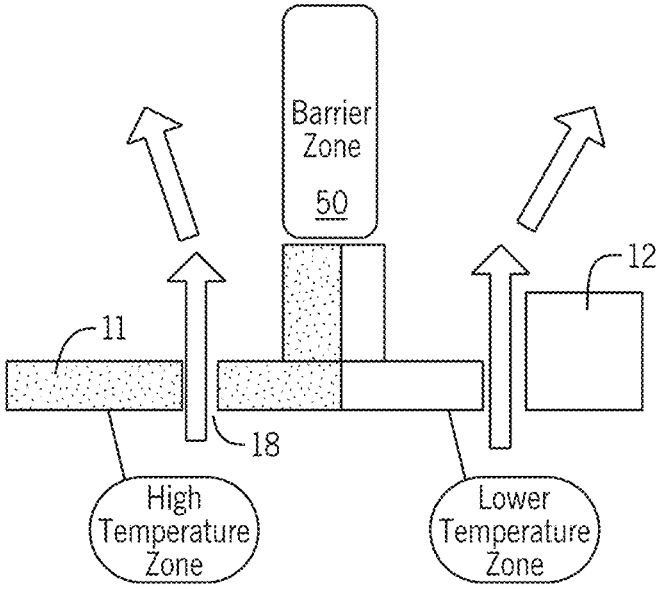
FIG. 21 is a schematic side-view illustration of a light-fixture configuration including a solid thermal barrier separating fixture zones with higher and lower permitted operating temperatures.
Figure 22:
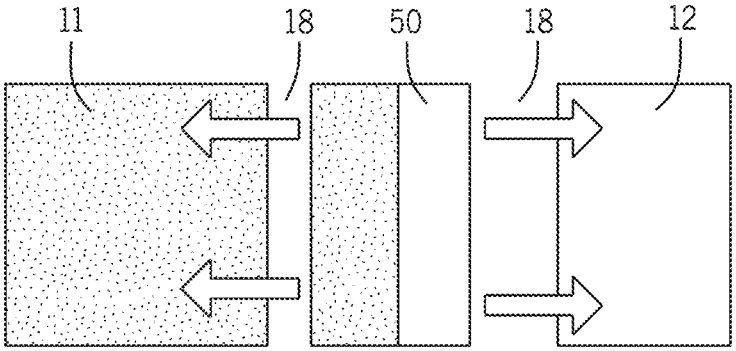
FIG. 22 is a schematic sectional plan view of the light-fixture illustrated in FIG. 21, taken along lines 22-22 seen in FIG. 21.

FIGS. 17 and 32 show heat conductive structures 30 including a barrier structure 50 further dividing inner venting aperture 36 to separate paths for air flow corresponding to each of the adjacent LED light sources, as illustrated in FIGS. 7, 8 and 11.

Figure 12:
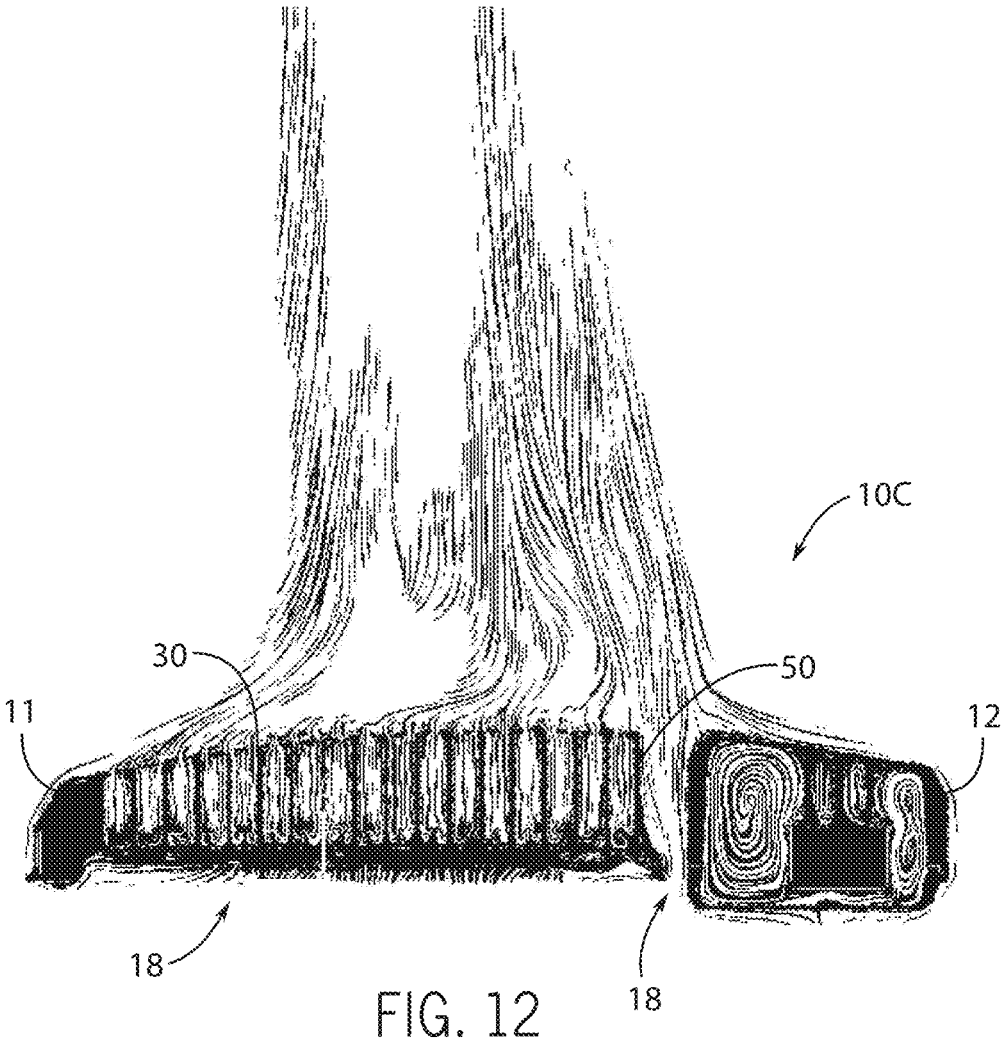
FIG. 12 is a schematic cross-sectional side view of an embodiment including a venting gap between the heat sink and a driver-circuitry chamber and a perforated cover in thermal contact with side-to-side heat-sink fins, showing streamlines of air through the fixture and thermal isolation of the two fixture zones.
Figure 13:
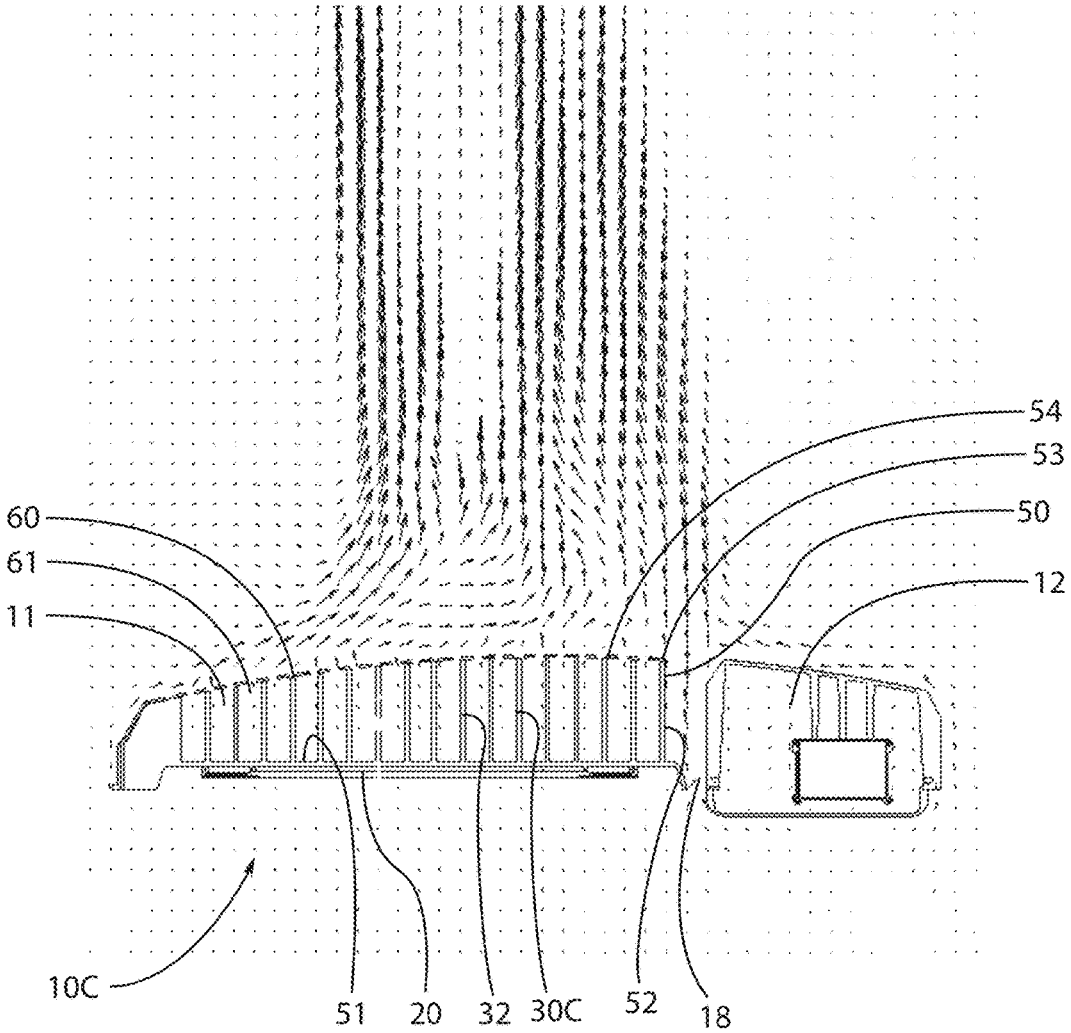
FIG. 13 is another schematic cross-sectional side view of the embodiment of FIG. 12 showing air-flow vectors through the fixture.
Figure 14:
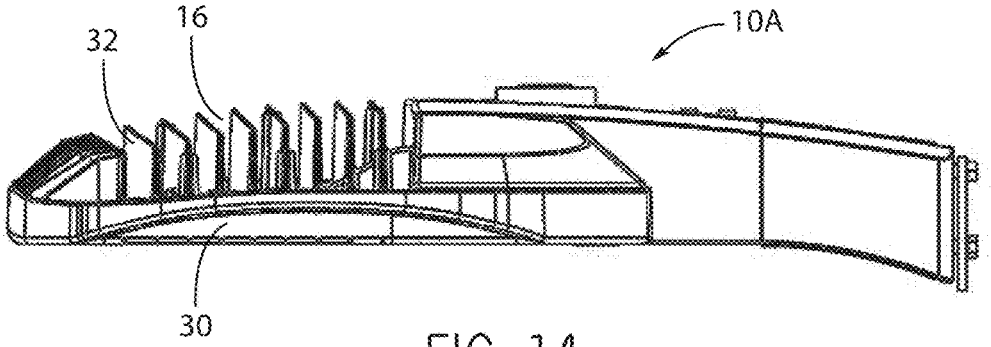
FIG. 14 is a side view of the LED light fixture of FIG. 1.
Figure 15:
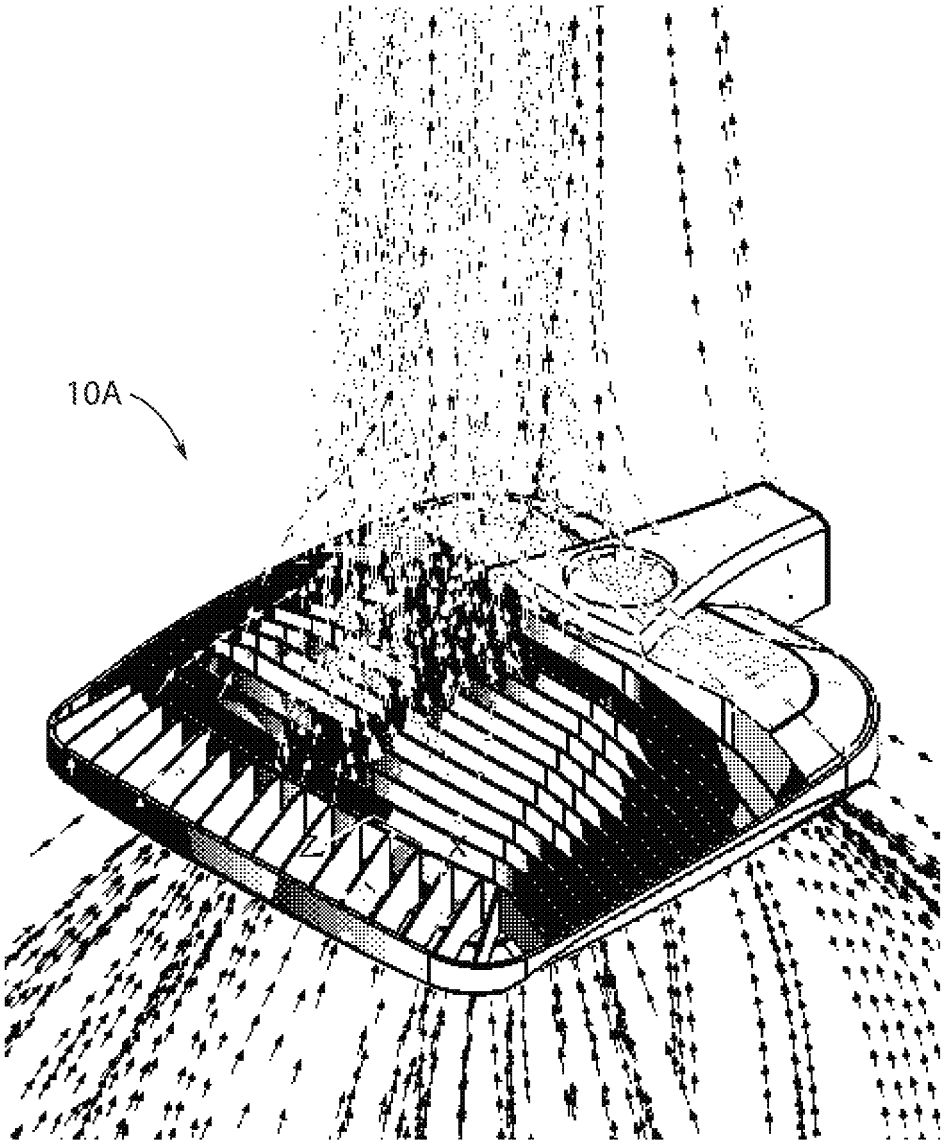
FIG. 15 is another perspective view of the LED light fixture of FIG. 1 schematically illustrating air-flow vectors through the fixture.
Figure 16:
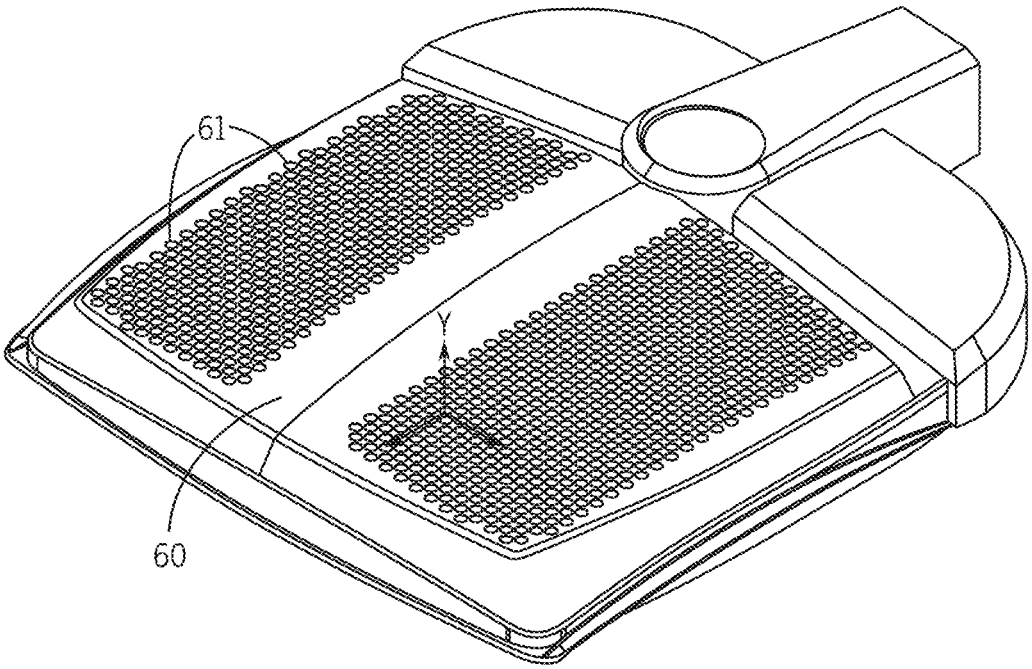
FIG. 16 is a perspective view of one version of the embodiment with a perforated cover over an LED heat sink.

FIGS. 11-13, 17 and 18-25 illustrate another aspect of this invention showing LED fixture 10C having first fixture portion 11 and second fixture portion 12, LED light source 20 being on an LED heat sink 30 in first fixture portion 11. FIGS. 12, 13 and 18-24 show first and second fixture portions 11 and 12 defining openings 18 permitting ambient-fluid flow through fixture 10C. It is seen in FIGS. 12 and 13 that LED heat sink 30 is open to ambient-fluid flow for removal of heat generated by LEDs emitters 21 during operation. FIGS. 12, 13 and 18-24 further show that LED light fixture 10C includes barrier structure 50 along opening 18 to thermally isolate second fixture portion 12 from the air flow heated by first fixture portion 11.

Figure 26:
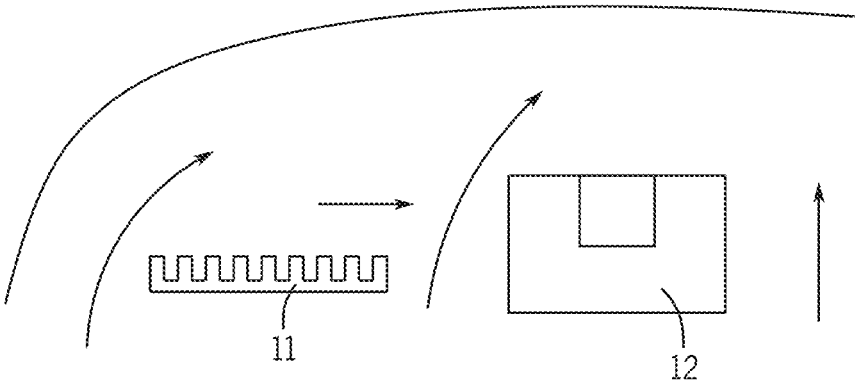
FIG. 26 PRIOR ART
FIG. 26 is a schematic side view of a prior light fixture illustrating air-flow streams transferring heat from a high-temperature fixture zone to a lower-temperature fixture zone.

FIG. 26 schematically illustrates a prior light fixture without a thermal barrier. FIG. 26 shows air flowing through a heat sink and being heated to temperatures that may be in the range of about 85° C. Such "superheated" air comes in contact with a heat-conductive structure forming a chamber for driver-circuitry components. Through such contact, the "superheated" air transfers some of such heat to such chamber-forming heat-conductive structure. This is highly undesirable because operating temperatures of driver-circuitry components should not exceed 65° C. to maintain the longevity of driver-circuitry components similar to the longevity of the LEDs.

FIGS. 12 and 13 show first fixture portion 11 and second fixture portion 12 at least partially extending along a common plane 51 with openings 18 permitting ambient-fluid flow through fixture 10C transverse common plane 51.

FIGS. 18-24 schematically illustrate first fixture portion 11 and second fixture portion 12 formed as one piece.

FIGS. 12 and 13 also show that heat sink 30C has an edge-fin 52 transverse to common plane 51 and extending along opening 18 away from LED emitter 21 to a distal edge-fin end 53. Edge-fin 52 is shown to form barrier structure 50.

Figure 23:
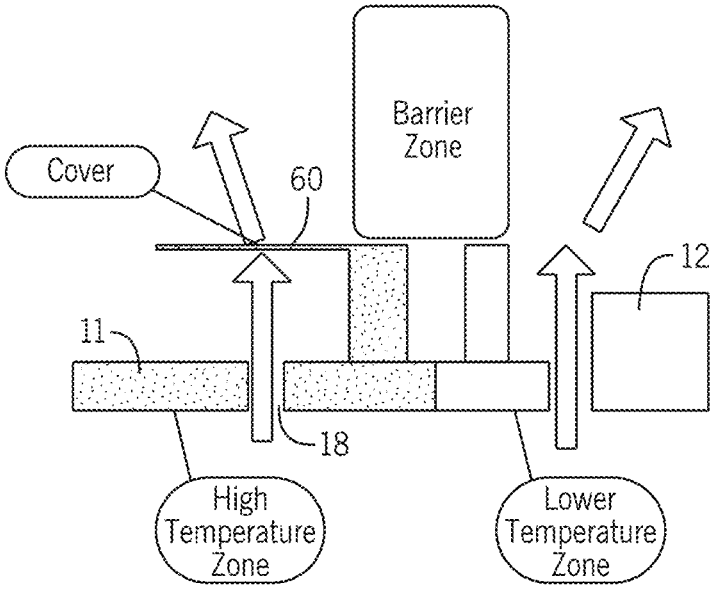
FIG. 23 is a schematic side-view illustration of a light-fixture configuration as in FIG. 18 but including a perforated cover over the high-temperature zone.
Figure 24:
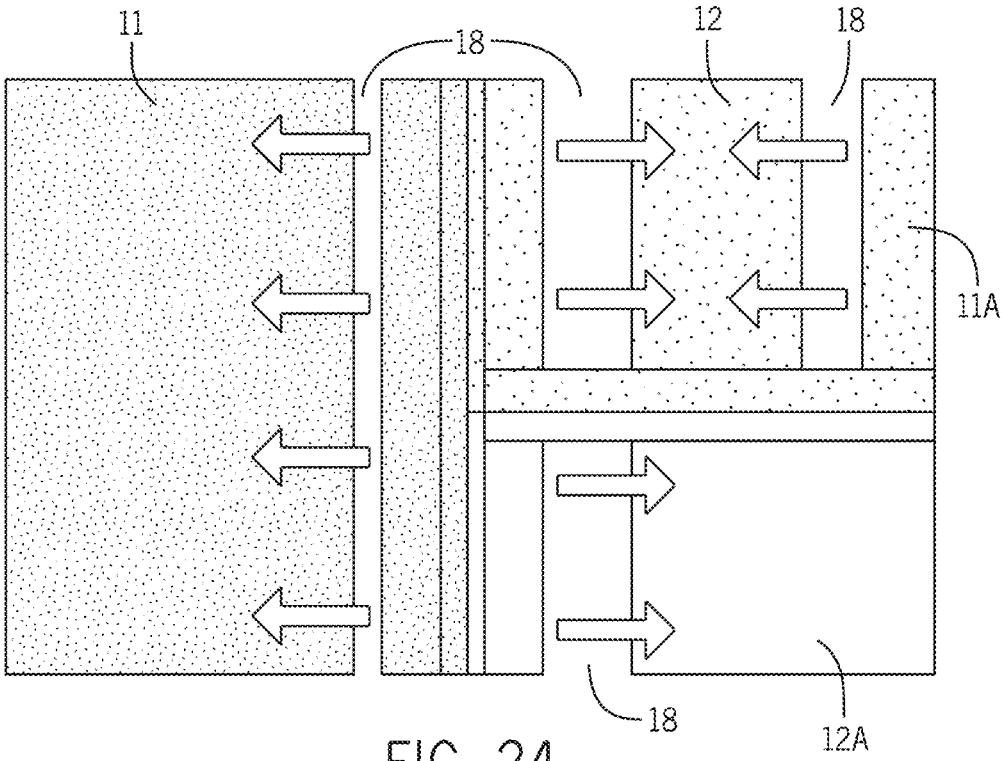
FIG. 24 is a schematic plan view of a light-fixture configuration with barriers thermally isolating three fixture zones each with different permitted operating temperatures.
Figure 25:
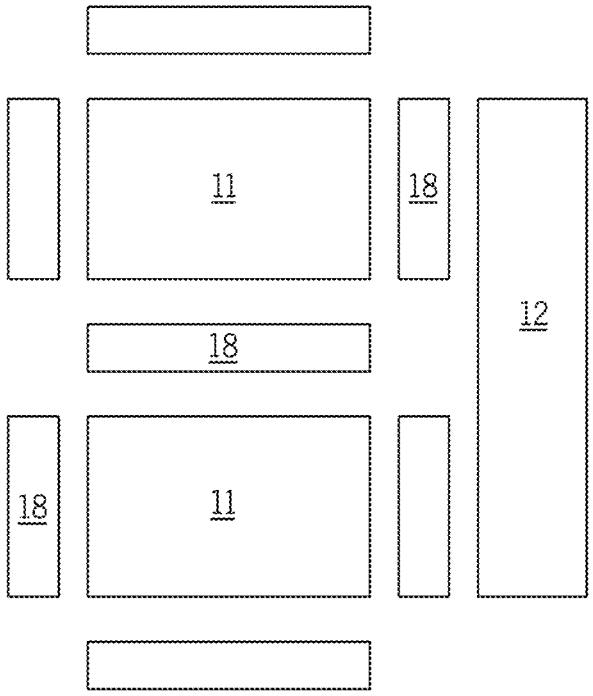
FIG. 25 is a schematic bottom plan view of a light fixture having venting apertures between fixture zones with common and different permitted operating temperatures.

FIGS. 12, 13 and 23 show a perforated cover 60 in contact with distal edge-fin end 53 and extending therefrom substantially along common plane 51 away from opening 18. Perforations 61 of cover 60 further direct LED-generated heat carried by the fluid flow along first fixture portion 11 away from second fixture portion 12.

Figure 9:
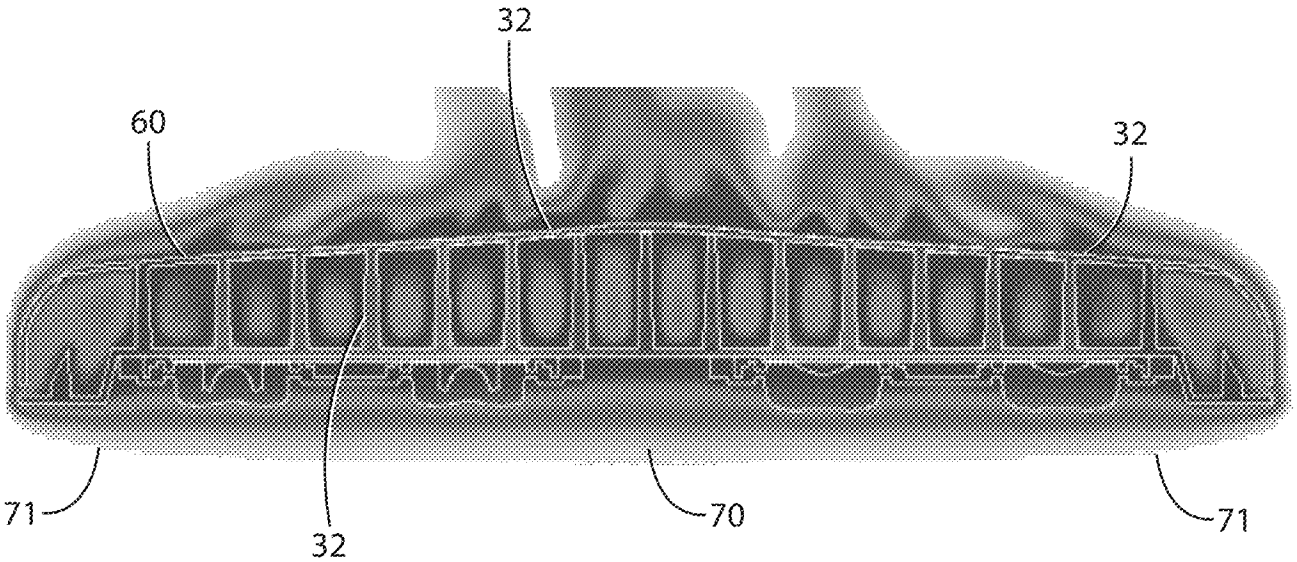
FIG. 9 is a schematic cross-sectional front view of an embodiment with a perforated cover in thermal contact with front-to-back heat-sink fins, showing heat dissipation during operation, including closed channels formed by the cover and the adjacent fins facilitating heat transfer.
Figure 10:
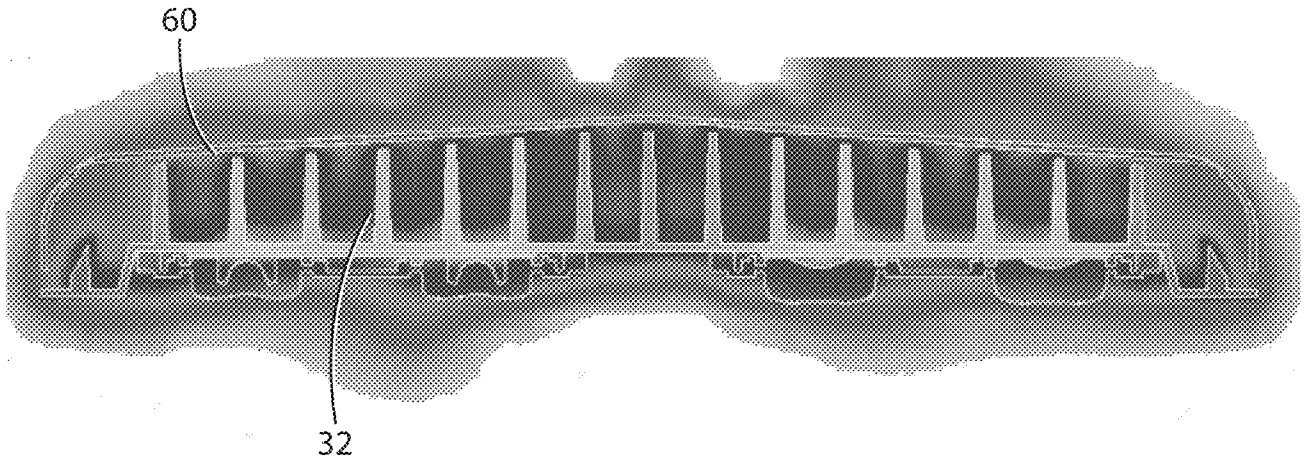
FIG. 10 is another schematic cross-sectional front view of an embodiment with a perforated cover over and spaced from front-to-back heat-sink fins, illustrating the difference in heat dissipation during operation.

FIGS. 9-13 show heat sink 30 including a plurality of fins 32 extending away from LED emitters 21 to distal fin ends 54. FIG. 9 best show that cover 60 is in thermal contact with the distal fin edges and conductively receives heat from fins 32.

FIGS. 6, 9-13 show fins 30 being taller in a central region 70 than in peripheral regions 71. Because the airflow velocity is higher in the center than along the periphery, fins being taller in the center enhances the fin efficiency for the given airflow.

While the principles of the invention have been shown and described in connection with specific embodiments, it is to be understood that such embodiments are by way of example and are not limiting.

The invention claimed is:

1. An LED light fixture comprising a pair of walls at least partially extending along a common plane at opposite sides of at least one opening permitting ambient-fluid flow through the fixture adjacent to an LED heat sink supporting at least one LED emitter and being open to ambient-fluid flow for removal of heat generated by the at least one LED during operation, one of the walls being of a second fixture portion forming a substantially closed chamber with permitted operating temperatures different than operating temperatures of the at least one LED emitter supported by the LED heat sink.

2. The LED light fixture of claim 1 wherein the chamber encloses a power-circuitry unit with permitted operating temperatures lower than operating temperatures of the at least one LED emitter.

3. The LED light fixture of claim 2 wherein the heat-sink comprises at least one edge-fin extending along the opening away from the at least one LED emitter to a distal edge-fin end.

4. The LED light fixture of claim 3 wherein the at least one edge-fin forms the barrier structure disposed between openings corresponding to the adjacent fixture portions and separating paths of different-temperature fluid flow through such openings during operation.

5. The LED light fixture of claim 2 further comprising a barrier structure disposed within the at least one opening between the LED heat sink and the second fixture portion, thereby dividing such opening into a pair of separate ambient-fluid flow paths each corresponding to one of the LED heat sink and the second fixture portion.

6. The LED light fixture of claim 3 further comprising a perforated cover in contact with the distal edge-fin end and extending therefrom away from the opening.

7. The LED light fixture of claim 6 wherein the heat sink comprises a plurality of fins extending away from the at least one LED emitter to distal fin ends.

8. The LED light fixture of claim 7 wherein the cover is in thermal contact with the distal fin ends.

9. The LED light fixture of claim 1 wherein the heat sink comprises a base with an LED-supporting region and an opposite heat-dissipating region which includes a plurality of fins extending away from the at least one LED emitter to the distal fin ends.

10. The LED light fixture of claim 9 wherein the plurality of fins includes:

at least one edge-fin extending along the opening; and at least a subset of fins extending substantially parallel to the edge-fin.

11. The LED light fixture of claim 10 wherein the heat sink further comprises at least one central venting aperture facilitating ambient-fluid flow to and from a central region of the heat sink.

12. The LED light fixture of claim 11 wherein the heat sink has at least one peripheral venting aperture along peripheral regions facilitating ambient-fluid flow to and from the heat-dissipating region of the heat sink.

13. The LED light fixture of claim 12 wherein the fins are taller along the central region than along the peripheral regions.

14. The LED light fixture of claim 12 wherein at least some fins of the subset define horizontal between-fin channels open at the peripheral regions and extending therefrom to the central region.

15. The LED light fixture of claim 14 further including a peripheral deflector member along each of the peripheral venting apertures, the peripheral deflector member having at least one beveled deflector surface oriented to redirect inwardly upward air flow from the peripheral venting aperture toward the central region.

16. The LED light fixture of claim 15 further including a central deflector member along the central venting aperture, the central deflector member having a pair of oppositely-facing beveled deflector surfaces oriented to accelerate and redirect inwardly upward air flow from the central venting aperture toward peripheral regions.

17. The LED light fixture of claim 10 wherein the heat sink has a central region bordered by peripheral regions with at least one peripheral venting aperture along the peripheral regions.

18. The LED light fixture of claim 17 wherein at least some fins of the subset define horizontal between-fin channels open at the peripheral regions facilitating ambient-fluid flow from the peripheral venting aperture toward the central region.

19. The LED light fixture of claim 18 further including a peripheral deflector member along each peripheral venting aperture, each peripheral deflector member having at least one beveled deflector surface oriented to accelerate and redirect inwardly upward air flow from the peripheral venting aperture toward the central region.

20. The LED light fixture of claim 1 wherein the LED heat sink and the second fixture portion are formed as one piece.

21. An LED light fixture comprising:

a heat-conductive structure comprising an LED-supporting region and heat-dissipating surfaces extending away therefrom, at least one LED light source being thermally coupled to the LED-supporting region, the heat-conductive structure defining venting apertures bordering the at least one LED light source and open for ambient fluid flow to and from the heat-dissipating surfaces; and a pair of walls at least partially extending along a common plane and along at least one opening permitting ambient-fluid flow through the fixture, one of the walls being of a second fixture portion forming a substantially closed chamber, the other of the walls being a protrusion extending into the at least one of the openings, thereby dividing such opening into a pair of separate ambient-fluid flow paths each corresponding to one of the heat-conductive structure and the second fixture portion.

22. The LED light fixture of claim 21 wherein the protrusion is part of the heat-conductive structure and extends outwardly from the LED-supporting region thereof.

23. The LED light fixture of claim 21 wherein the protrusion is part of the LED light source and extends outwardly from the at least one LED emitter.

24. The LED light fixture of claim 21 further comprising a lens member secured to the heat-conductive structure and enclosing the at least one LED light source, the lens member comprising at least one light-transmissive lens portion and an edge portion extending outwardly therefrom, the edge portion forming the protrusion and having a beveled rear surface bordering a corresponding one of the venting apertures.

25. The LED light fixture of claim 24 further comprising a deflector member extending along each of the venting apertures toward the heat-dissipating surfaces, the deflector member having at least one beveled deflector surface angled off-vertical in substantially common direction as the beveled rear surface of the lens member and oriented to redirect inwardly upward air flow from the venting aperture toward the heat-dissipating surfaces.

26. The LED light fixture of claim 25 wherein each deflector member is part of the heat-conductive structure.

27. The LED light fixture of claim 26 wherein each deflector member and the heat-conductive structure are parts of a single-piece structure.

28. The LED light fixture of claim 21 wherein:

the at least one LED light source includes a plurality of spaced apart LED light sources;

the venting apertures include at least one inner venting aperture between adjacent LED light sources and peripheral venting apertures bordering the LED-mounting region; and the protrusion extends into the at least one inner venting aperture.

29. The LED light fixture of claim 28 further comprising a lens member secured to the heat-conductive structure and enclosing the at least one LED light source, the lens member comprising at least one light-transmissive lens portion and an edge portion extending outwardly therefrom, the edge portion forming the protrusion and having at least one edge portion with the beveled rear surface bordering the at least one inner venting aperture.

30. The LED light fixture of claim 28 further comprising a peripheral deflector member along each of the peripheral venting apertures, the peripheral deflector member having at least one beveled deflector surface angled off-vertical in substantially common direction as the beveled rear surface of the lens member and oriented to redirect inwardly upward air flow from the peripheral venting aperture toward the heat-dissipating surfaces.

31. The LED light fixture of claim 30 further including an inner deflector extending into the at least one inner venting aperture toward the heat-dissipating surfaces, the inner deflector having a pair of oppositely-facing beveled deflector surfaces each angled off-vertical in substantially common direction as the beveled rear surface of the adjacent lens member and oriented to redirect inwardly upward air flow from the peripheral venting aperture toward the heat-dissipating surfaces.

32. The LED light fixture of claim 31 wherein each deflector member and the heat-conductive structure are parts of a single-piece structure.

33. An LED light fixture comprising a pair of walls at least partially extending along a common plane and along at least one opening permitting ambient-fluid flow through the fixture adjacent to a heat-conductive structure having an LED-supporting region and heat-dissipating fins extending away therefrom, the heat-conductive structure defining a plurality of venting apertures adjacent at least one LED light source thermally coupled to the LED-supporting region, the fins increasing in height at positions adjacent to at least one of the venting apertures.

34. The LED light fixture of claim 33 wherein:

the at least one LED light source includes a plurality of spaced apart LED light sources; and the venting apertures include at least one inner venting aperture between adjacent LED light sources and peripheral venting apertures bordering the LED-mounting region; and the fins increase in height at positions adjacent the at least one inner venting aperture.

35. The LED light fixture of claim 34 wherein:

the fins span between the peripheral venting apertures and form between-fin channels across the heat-conductive structure; and a peripheral deflector member is positioned along each peripheral venting aperture, each peripheral deflector member having at least one beveled deflector surface oriented to redirect inwardly upward air flow from the peripheral venting aperture to the heat-dissipating fins and along the between-fin channels.

36. The LED light fixture of claim 35 further including an inner deflector member along the at least one inner venting aperture, the inner deflector member having a pair of oppositely-facing beveled deflector surfaces oriented to redirect inwardly upward air flow from the at least one inner venting aperture to the heat-dissipating fins and along the between-fin channels.

37. The LED light fixture of claim 34 further comprising a barrier structure dividing the inner venting aperture to separate flow paths corresponding to each of the adjacent LED light sources.

38. An LED light fixture comprising:

at least one LED light source comprising at least one longer side and at least one shorter side;

a pair of walls at least partially extending along a common plane and along at least one opening permitting ambient-fluid flow through the fixture at the shorter side of the LED light source thermally coupled to an LED-supporting region of a heat-conductive structure comprising heat-dissipating surfaces extending away from the LED-supporting region, the heat-conductive structure defining venting apertures bordering the at least one longer side of each of said at least one LED light source.

39. The LED light fixture of claim 38 wherein:

the at least one LED light source includes a plurality of spaced apart LED light sources each having longer sides and shorter sides; and a venting aperture bordering each of the longer sides of each of the LED light sources.

40. An LED light fixture comprising:

at least three fixture portions defining at least one opening corresponding to each of the fixture portions, at least one of the fixture portions forming a substantially closed chamber, each opening permitting ambient-fluid flow through the fixture for removal of heat generated during operation; and a pair of walls at least partially extending along a common plane and along the at least one opening between each adjacent pair of the fixture portions, one of the walls being of the fixture portion forming the chamber.

41. The LED light fixture of claim 40 wherein the fixture portions include first and second fixture portions, the first fixture portion including an LED heat sink with at least one LED emitter thereon, the LED heat sink being open to ambient-fluid flow for removal of heat generated by the at least one LED during operation, the second fixture portion being adjacent the first fixture portion and forming a substantially closed chamber enclosing a power-circuitry unit with permitted operating temperatures lower than operating temperatures of the at least one LED emitter.

42. The LED light fixture of claim 40 wherein the thermal barrier structure is disposed within one opening between the adjacent fixture portions, thereby dividing such opening into a pair of separate ambient-fluid flow paths each corresponding to one of such adjacent fixture portions.

* * * * *